US006942715B2

(12) United States Patent
Ito et al.

(10) Patent No.: US 6,942,715 B2
(45) Date of Patent: Sep. 13, 2005

(54) PROCESS FOR PRODUCING METALLIC TITANIUM

(75) Inventors: Nobuaki Ito, Chiba (JP); Masanori Yamaguchi, Kanagawa (JP); Kenichi Kato, Kanagawa (JP); Shigeo Ampo, Kanagawa (JP)

(73) Assignee: Toho Titanium Co., Ltd., Chigasaki (JP)

( * ) Notice: Subject to any disclaimer, the term of this patent is extended or adjusted under 35 U.S.C. 154(b) by 354 days.

(21) Appl. No.: 10/406,385

(22) Filed: Apr. 4, 2003

(65) Prior Publication Data

US 2003/0196515 A1 Oct. 23, 2003

(30) Foreign Application Priority Data

Apr. 19, 2002 (JP) ..... 2002-117281

(51) Int. Cl.[7] ..... B22F 9/24

(52) U.S. Cl. ..... 75/345; 75/368; 75/371; 75/619

(58) Field of Search ..... 75/345, 368, 371, 75/619

(56) References Cited

U.S. PATENT DOCUMENTS 4,518,426 A * 5/1985 Murphy ..... 75/619
5,032,176 A * 7/1991 Kametani et al. ..... 75/416
5,259,862 A * 11/1993 White et al. ..... 75/363

* cited by examiner

*Primary Examiner*—George Wyszomierski
(74) *Attorney, Agent, or Firm*—Oblon, Spivak, McClelland, Maier & Neustadt, P.C.

(57) ABSTRACT

A process for producing metallic titanium includes forming metallic titanium fine particles by supplying liquid or mist titanium tetrachloride from above the surface of a reaction bath liquid containing fused magnesium and fused magnesium chloride in a reaction vessel to effect a reaction, wherein a circulating flow perpendicular to the bath surface of the reaction bath liquid is generated or extended just under the bath surface by imparting a stirring force to the reaction bath liquid so as to generate or increase an upward flow rate of the reaction bath liquid in at least part of the region at a depth of more than 100 mm below the bath surface.

9 Claims, 14 Drawing Sheets

PROCESS FOR PRODUCING METALLIC TITANIUM

FIELD OF THE INVENTION

The present invention relates to a process for producing metallic titanium capable of achieving an efficient reaction particularly in the reduction step of reducing titanium tetrachloride with fused magnesium, in the Kroll process wherein metallic titanium is produced by chlorinating titanium ore to form titanium tetrachloride and reducing it.

BACKGROUND ART

With regard to the reduction step of obtaining metallic titanium from titanium tetrachloride as an intermediate product among the steps for producing metallic titanium from titanium ore, so-called Kroll process is most commonly adopted industrially. The following will describe a process for reducing titanium in the Kroll process with reference to FIG. 22.

After titanium ore has been chlorinated to be processed into titanium tetrachloride which is liquid at room temperature beforehand, through a liquid titanium tetrachloride supply pipe 8, titanium tetrachloride is dropped to a tightly closed reduction reaction vessel 1, i.e., onto a reaction bath liquid 2 containing fused magnesium as a main component at an average temperature of about 800° C. which is stored beforehand at the bottom of the reaction vessel 1. Then, highly pure metallic titanium is obtained by chemical change of magnesium into magnesium dichloride and of titanium tetrachloride into metallic titanium through chemical reaction in the reaction vessel.

Metallic titanium precipitates as fine particles on the bottom of the reaction vessel and then the particles are sintered each other to form a porous sponge titanium mass 4. Moreover, magnesium dichloride as the by-product precipitates on the bottom of the vessel to form a magnesium dichloride bath 3 owing to its larger specific gravity than that of magnesium. By adequately discharging the magnesium dichloride bath to the outside of the vessel through a magnesium dichloride discharge pipe 9, the surface level of the reaction bath liquid is maintained within a certain range. After the accumulated amount of titanium tetrachloride dropped has reached a predetermined level, the reaction bath liquid and magnesium dichloride are discharged to the outside of the vessel and the sponge titanium 4 is taken out of the vessel as a product after separating the bath liquid remained in the voids by heating in vacuo. In the case of recent representative large scale reduction reaction apparatus, the size of the reaction vessel is up to a diameter of about 2 m, a height of about 5 m, and a distance from the outlet of the titanium tetrachloride supply pipe 8 to the reaction bath surface of about 1 m, and a little less than 10 tons of sponge titanium is produced at one batch production. As the titanium tetrachloride supply pipe 8 including the outlet, a pipe having a diameter of 20 mm or more is usually used in order to avoid blockage at the outlet of the supply pipe, and a pipe having an enlarged end may be used in some cases in order to extend the dropping range of titanium tetrachloride. On the other hand, since the supply of liquid titanium tetrachloride is 250 $kg/m^2 \cdot hr$ at most, liquid titanium tetrachloride does not fill the supply pipe completely and the flow runs down along part of the pipe wall and is dispersed as a gas-liquid two-phase flow. Therefore, even when an original pressure of a supplying system is about tens of thousands Pa, it is difficult for titanium tetrachloride after discharged to maintain the momentum corresponding to the original pressure of the supplying system owing to a large pressure loss at discharging. Liquid titanium tetrachloride after discharged from the titanium tetrachloride supply pipe 8 drops as a large number of nearly free-falling drops 7 of liquid titanium tetrachloride while dispersed into a range having a radius of several hundred mm on the reaction bath surface 6.

Since the formation of metallic titanium from titanium tetrachloride is accompanied by a strong heat generation, reduction of heat from the reaction vessel is an important problem in the production. The reduction of heat from the reaction vessel 1 is effected by cooling, e.g., jetting air toward the outer wall of the reaction vessel 1 or the like. However, it is known that a heat load is concentrated to the outer wall corresponding to the vicinity of the reaction bath liquid surface 6, i.e., a larger amount of cooling jet flow is necessary at the wall.

An industrial large reaction vessel is usually made of steel and the eutectic temperature of iron-titanium alloy is about 1080° C. Therefore, when an inner wall temperature of the reaction vessel exceeds the temperature, there arise problems that dissolution of the reaction vessel wall remarkably shortens the life of the reaction vessel and also dissolved iron contaminates product titanium. Accordingly, in order to maintain the wall temperature of the reaction vessel at the temperature or lower, the flow rate of titanium tetrachloride should be limited to a certain upper limit, which is the most serious bottleneck of productivity in the conventional operation. In the past, many efforts have been made for improving the productivity.

For example, JP-A-7-41880 discloses an attempt to accelerate the removal of heat by mist-cooling of the outer wall of the vessel. (The term "JP-A" as used herein means an "unexamined published Japanese patent application.) Moreover, acceleration of cooling is attempted by inserting a cooling pipe into the reaction vessel in Japanese Patent No. 2883905. Although these inventions achieve the effect of cooling to some extent, but expensive incidental facilities are required and the effect is extremely restricted, so that they cannot be drastic measures. In order to improve cooling efficiency fundamentally, it is necessary to carry out structural improvement of securing a wide heat transfer area. However, there arises a problem that it is necessary to make a heat transfer wall, which itself is a highly heat-resistive element, thicker in view of strength, but the heat transfer efficiency again decreases thereby.

In consideration of the fact that the heat load concentration to the wall of the reaction vessel near the bath surface induces difficulty in improvement of the productivity, JP-A-7-41881 aims at homogenization of the bath temperature by inserting a titanium pipe having numerical openings into the bath liquid and stirring the bath by discharging argon gas from the openings into the bath. In JP-A-7-41881, however, there is only a description that "the heat transfer and temperature distribution in the bath are improved and hence the dropping rate of titanium tetrachloride is increased to enhance the productivity", which is induced by discharging of argon gas into the bath, and conditions such as the surface temperature of the bath liquid and discharging depth of argon gas in the bath are not clear at all, although the conditions influence the heat load concentration to the wall of the reaction vessel critically. Actually, based on the findings of precise investigation in actual operation by the present inventors, it was confirmed that a strong circulating flow existed in the reaction bath liquid in the actual operation. It was observed that the mere discharge of argon gas into the bath hardly generates a stirring enhancing effect but argon gas bubbles were filled with magnesium vapor in the bath and, after they were released into over-bath gas 5, the vapor reacted with titanium tetrachloride vapor in the over-bath gas, so that a phenomenon of inhibiting the productivity was observed owing to the increase of the temperature of the reaction bath surface 6. That is, the inert gas discharged into the bath may cause either the case of reducing the temperature difference in the reaction vessel or the case of enlarging the difference depending on its position in the bath to be discharged and the amount of the gas supplied, so that it is not always observed that the discharge of an inert gas into the bath may result in a bath temperature-homogenizing effect.

Moreover, for the purpose of stirring the bath liquid similarly, JP-A-7-252549 describes an attempt that a liquid titanium tetrachloride-supply pipe is inserted into the bath, titanium tetrachloride is discharged in the magnesium dichloride bath to form bubbles by vaporization of titanium tetrachloride, the vaporized titanium tetrachloride is chemically reacted with the reaction bath liquid mainly composed of magnesium which is present above the magnesium dichloride, and thereby the bath liquid is stirred by the ascending bubbles collaterally. However, JP-A-7-252549 does not aim at temperature homogenization of a high temperature region near the bath surface, which may form due to a large amount of chemical reaction-generated heat in the vicinity of the bath surface, by a stirring effect caused by a gas-bubbling effect. This is because JP-A-7-252549 describes as follows: "when $TiCl_4$ is supplied to fused $MgCl_2$ layer, bubbles of $TiCl_4$ which start to react at the lowest layer of the fused Mg layer ascend in fused Mg until the reduction reaction is completed", "the reduction reaction is started", and "the heat of reaction generated therein is diffused into the upper layer of the fused Mg layer via fused Mg and also is transferred to the lower layer of the fused $MgCl_2$ layer by precipitation of the formed titanium and descent of $MgCl_2$. Therefore, localized generation of the heat of reaction does not occur". Thus, JP-A-7-252549 clearly intends that the reaction of titanium tetrachloride be completed in the bath. Moreover, there exists the description of "furthermore, the fused $MgCl_2$ layer and the fused Mg layer are stirred by the gas bubbling action of supplied $TiCl_4$ and the temperature distribution thereof becomes more homogeneous" in JP-A-7-252549. However, in JP-A-7-252549, the bath liquid stirring effect by gas-bubbling in the bath is collateral and the bath liquid having a little temperature difference owing to almost homogeneous heat generation in the bath is absolutely postulated. Furthermore, JP-A-7-252549 lacks specific descriptions on gas-bubbling conditions and bath liquid stirring mechanism by gas-bubbling. In addition, JP-A-7-252549 originally postulates a bath liquid having a little temperature distribution and describes no homogenizing effect of the bath liquid temperature by gas-bubbling itself. The problem of the invention described in JP-A7-252549 at the application to actual operation is that a long and large apparatus is required in order to finish the reaction of titanium tetrachloride bubbles released to the bath liquid completely in the bath liquid during their ascent in the case of a large supplying flow rate of titanium tetrachloride which corresponds to the conventional operating condition.

As described above, all the methods for reducing the heat load concentration to the wall of the reaction vessel in the conventional apparatus cannot be industrially adopted in actual operations. The problem common to these improved technologies is that, although the concentration of heat load of the reaction vessel to the vicinity of the bath surface is widely known as an operational fact, an effective improvement cannot be found out because of insufficient investigation on the physical cause of such a heat load distribution. Therefore, in the invention, in order to solve the problem, the reaction field in actual operation is precisely investigated to elucidate problems of the conventional art as physical phenomena.

FIG. 24 shows results of the investigation on a fluid temperature distribution in the axial direction inside the reaction vessel. In conventional actual operation, a bath temperature reaches a maximum temperature of, e.g., about 1000° C. on the bath surface and decreases rapidly to an average bath temperature just below the bath surface. That is, a high temperature layer exists just under the bath surface. On the other hand, the over-bath gas shows a maximum temperature in the region near the bath surface of 300 mm above the bath from the bath surface within the reaction vessel including the bath liquid. The reason why the temperature of the over-bath gas can maintain a high temperature despite of continuous cooling from the surrounding reaction vessel is because reaction-generated heat in the over-bath gas is extraordinarily large. FIG. 23 shows a conceptual illustration of the reaction on the bath surface and in an over-bath gas layer. The titanium tetrachloride drops 7 dropped into the reaction vessel 1 vaporize when reach a drop-falling point 11 in the reaction bath surface 6 and flow in the over-bath gas. During the flowing, part of titanium tetrachloride comes into contact with magnesium 13 in the bath surface to be reduced, which is defined as "bath surface reaction". Titanium tetrachloride which does not react is reduced by the reaction with magnesium vapor in the over-bath gas 12, which is defined as "reaction in the over-bath gas layer". Since the reaction of the titanium tetrachloride vapor with magnesium in a gas phase is kinetically difficult to occur, the reduction reaction in the over-bath gas is considered to occur mainly on fine particles floating in the over-bath gas. Most of the reaction-generated heat generated on the bath surface is transferred to the bath liquid side. This is because surrounding molecular density by which the heat generated at the gas-liquid interface is transferred is overwhelmingly higher at the liquid phase than in the gas phase. On the other hand, the reaction-generated heat in the over-bath gas layer increases the gas temperature to a certain temperature and then is transferred to the bath surface 6 and the inner wall of the reaction vessel 1 as the form of radiant heat to maintain the surface temperature of the bath liquid and the inner wall temperature of the reaction vessel at a high temperature. Therefore, this becomes one cause of concentrating a heat load to the wall 18 of the reaction vessel near the bath surface.

FIG. 7 shows the ratio of reaction quantity of the bath surface reaction 13 and the reaction 12 in the over-bath gas layer. In FIG. 7, abscissa represents the surface temperature of the reaction bath liquid and ordinate represents the ratio of the reaction rate in the over-bath gas to the total reaction rate. In the conventional art, the surface temperature of the reaction bath liquid is a high temperature of about 1000° C. and hence most of titanium tetrachloride dropped reacts in the over-bath gas. This is because saturated vapor pressure of magnesium shown in FIG. 6 is as high as the pressure of the over-bath gas owing to the high surface temperature of the reaction bath liquid in the conventional art and a large quantity of magnesium vapor is generated from the vicinity of the bath surface into the over-bath gas layer to cover the bath surface. Most of titanium tetrachloride vapor reacts with the magnesium vapor above the bath surface. As a result, titanium tetrachloride is consumed in the reaction with the over-bath gas before reaching the bath surface, so that the bath surface reaction hardly occurs.

FIG. 25 shows a flow field of the reaction bath liquid having such a heat distribution. As described above, a high temperature region exists just under the bath surface but this fact does not mean stillness of the bath liquid. Actually, a thin circulating flow 14 just under the bath surface exists in the perpendicular direction of the bath surface just under the bath surface, which results in temperature homogenization of the bath in the range that the circulating flow exists. In the case of a large reduction reaction vessel having a diameter of about 1 to 3 m, the thickness 15 of the circulating flow 14 just under the bath surface is about 100 mm or less. The "thickness 15 of the circulating flow just under the bath surface" means the length of the reaction bath range, wherein a circulating flow exists, in the depth direction from the bath surface, the circulating flow being generated by stirring the reaction bath liquid under the bath surface by imparting a compulsive force or natural convection, being in touch with the bath surface, and being circulated in the perpendicular direction in a time-average manner. The thickness of the circulating flow just under the bath surface can be determined by measuring the distribution of local time-average rate of the bath flow under the bath surface or by computing numerical values. The bath flow rate can be measured by inserting a current meter such as a Taft-type current meter or a Karman vortex current meter. Moreover, the thickness of the circulating flow just under the bath surface is not so influenced by the bath depth within the range of the bath depth of 1 to 5 m in a large reduction reaction vessel. Therefore, the value of about 100 mm or less for the thickness of the circulating flow just under the bath surface can be regarded as a common value in the conventional art. The force driving the circulating flow 14 just under the bath surface is as follows: firstly natural convection based on the temperature difference between a low temperature part of the bath liquid formed by cooling in the vicinity of the reaction vessel and a competitive high temperature part of the bath liquid formed by the reaction-generated heat in non-peripheral part of the bath and the radiant heat from the over-bath gas; secondly an upward stirring force based on the ascent of isolated bubbles (derived from titanium tetrachloride vapor+over-bath gas included into the bath) 20 at the drop-falling part 11 shown in FIG. 27. Since the titanium tetrachloride drops 7 to be dropped has a low rate almost near to free-fall, they cannot penetrate deeply into the bath liquid and may be removed by reaction or vaporization from the region 11 just under the bath surface. As a result that the titanium tetrachloride drops can penetrate into the bath only to a depth of about 100 mm below the bath surface at most, the portion at which the isolated bubbles generate is limited to a thin position within 100 mm below the bath surface. In addition, other than the circulating flow 14 just under the bath surface, a large number of circulating flows exist in the bath but the circulating flows which are not incorporated with the circulating flow 14 just under the bath surface are called circulating flows 16 at a deep position in the bath. Among the circulating flows at a deep position in the bath, a flow having a very large upward rate of up to several tens cm/s (FIG. 25, 16 (a)) exists but it hardly influences the temperature distribution of the circulating flow just under the bath surface. The behavior of the circulating flow just under the bath surface is controlled mainly by an entering or discharging heat distribution near the bath surface and a dropping state of titanium tetrachloride.

The reason why the thickness 15 of the circulating flow just under the bath surface becomes thin will be explained with reference to FIG. 26. Isothermal lines near the inner wall of the reaction vessel 1 just under the bath surface are represented by (a), (b), (c), and (d) in the order from a high temperature line. As a result of cooling the bath liquid by the inner wall of the reaction vessel, the maximum temperature part just under the bath surface has a lower temperature than the bath liquid temperature in the inner region in the radial direction of the vessel (a), so that a force to cause a downward flow along the inner wall of the reaction vessel works on the bath liquid. Next, as a result that a high temperature region of the bath surface is attracted by the above flow and flows into the vicinity of the inner wall of the reaction vessel to mix with the surrounding bath liquid having a low temperature, the temperature near the inner wall of the reaction vessel has been not always lower than that of the inner region (b) and the downward driving force has not been generated at this point of time, but the downward flow still remains by inertia near the inner wall surface of the reaction vessel. Furthermore, in the region near the inner wall of the reaction vessel at a lower part of the reaction vessel, the temperature of the region finally becomes higher than that of the inner region by the high temperature bath liquid entering from the upside along the wall surface (c), and an upward driving force is reversely generated near the inner wall surface to block further descent of the circulating flow. At this position, the circulating flow cannot descend along the inner wall of the reaction vessel any longer and turns to the inside direction of the reaction vessel. Namely, the bath liquid just under the bath surface strongly resists the descend of the bath liquid because of its extremely higher temperature as compared with the other part, but a strong stirring force derived from cooling of the reaction vessel and dropping of titanium tetrachloride is always imparted, so that a thin and high-speed circulating flow is formed just under the bath surface. Actually, the stirring force based on the density difference (temperature difference) imparted to the bath liquid just under the bath surface is estimated to reach several hundred N. Therefore, in the case that it is intended to enhance stirring by imparting a stirring force into the circulating flow just under the bath surface, an expectable effect may be small unless an additional force of at least several hundred N similar to the driving force of the circulating flow is imparted.

SUMMARY OF THE INVENTION

It is an object of the invention to increase the supplying flow rate of titanium tetrachloride by reducing the heat load concentration to the reaction vessel wall in the conventional art as described above, as a result, to enhance production efficiency of sponge titanium.

As a result of the extensive studies based on the results of analyzing the reaction field in the above actual operation, the present inventors have solved the problems which have remained in the conventional art and have accomplished the invention.

That is, the process for producing metallic titanium of the invention comprises, as the first invention, forming metallic titanium fine particles by supplying liquid or mist titanium tetrachloride from above the surface of a reaction bath liquid composed of fused magnesium and fused magnesium chloride in a reaction vessel to effect a reaction, wherein a circulating flow of the reaction bath liquid perpendicular to the bath surface is generated or extended just under the bath surface by imparting a stirring force to the reaction bath liquid so as to generate or increase an upward flow rate of the reaction bath liquid in at least part of the region at a depth of more than 100 mm below the bath surface of the reaction bath liquid.

As the second invention, an average temperature of the reaction bath liquid is set at 770° C. or higher and a maximum temperature on the bath surface is set at 950° C. or lower in the first invention.

As the third invention, the stirring force is imparted to the reaction bath liquid by inserting a screw into the reaction bath liquid and rotating the screw in the first invention.

As the fourth invention, the stirring force is imparted to the reaction bath liquid by inserting a rod-like or spatular structure into the reaction bath liquid and rotating or oscillating the structure or moving it upward and downward in the first invention.

As the fifth invention, the stirring force is imparted to the reaction bath liquid by providing a gas outlet nozzle in the reaction bath liquid and discharging a gas non-reactive with the reaction bath liquid into the reaction bath from the outlet in the first invention.

As the sixth invention, titanium tetrachloride is supplied and also the stirring force is imparted to the reaction bath liquid by introducing back-pressured titanium tetrachloride into the reaction bath liquid through a nozzle placed above the bath surface of the reaction bath liquid toward the bath surface to allow titanium tetrachloride to reach a depth of more than 100 mm below the bath surface in the first invention.

As the seventh invention, the nozzle has a minimum inner diameter of 1 to 10 mm and a region at which the cross-sectional shape and cross-sectional area of the nozzle are maintained constant over a length of 1 mm or more in the direction of nozzle axis at the nozzle outlet or in the vicinity of the nozzle outlet, and a static pressure difference between inlet and outlet of the nozzle is kept in the range of 100,000 to 5,000,000 Pa and a distance between the nozzle end and the bath surface is in the range of 50 to 2000 mm in the sixth invention.

As the eighth invention, the stirring force is imparted to the reaction bath liquid by applying an electromagnetic stirring force to the reaction bath liquid from the outside of the reaction vessel in the first invention.

By applying the invention, it is possible to increase a supplying flow rate of titanium tetrachloride into a reaction vessel, and thereby the productivity of metallic titanium can be largely improved.

Figure 1:
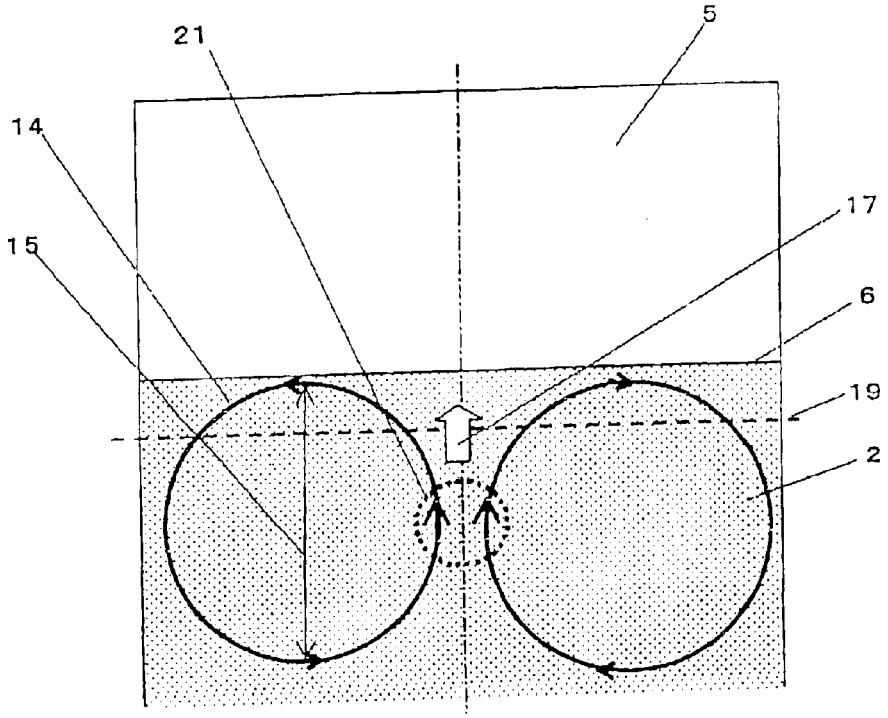
FIG. 1 is a conceptual illustration of a bath liquid flow field in the first invention.

The following are descriptions of reference numericals.

1. Reaction vessel wall
2. Reaction bath liquid
3. Magnesium dichloride bath liquid
4. Sponge titanium mass
5. Over-bath gas
6. Bath surface
7. Titanium tetrachloride drop
8. Liquid titanium tetrachloride-supply pipe
9. Magnesium dichloride discharge pipe
10. Titanium chloride vapor flow
11. Titanium tetrachloride drop-falling part
12. Over-bath gas reduction reaction part
13. Bath surface reduction reaction part
14. Circulating flow just under bath surface
15. Thickness of circulating flow just under bath surface

16. Circulating flow at deep position in bath
17. Stirring force
18. Heat load concentrated part of reaction vessel wall
19. Position at a depth of 100 mm below bath surface
20. Isolated bubbles in titanium chloride bath
21. Upward reaction bath liquid flow
22. Screw
23. Transfer axis
24. Seal mechanism
25. Actuator
26. Stirring bar
27. Stirring gas-supply pipe
28. Stirring gas bubble
29. Nozzle
30. Liquid titanium tetrachloride jet flow
31. Cave-like titanium chloride vapor film
32. Penetration depth from bath surface
33. Pump
34. Titanium tetrachloride tank
35. Regulation valve
36. Compressor
37. Argon gas bomb
38. Coil
39. Pinch force

DETAILED DESCRIPTION OF THE INVENTION

First, essential points of the difference between the first invention and the conventional art are described. In the conventional art, a circulating flow perpendicular to the bath surface exists only in the narrow range of the length of 100 mm or less in the depth direction from the bath surface inside the reaction bath liquid and a heat load by chemical reaction-generated heat is concentrated to the reaction vessel near the bath surface, so that the productivity is regulated. On the other hand, in the first invention, by imparting external stirring force to the reaction bath liquid by means of an apparatus having a stirring function, a circulating flow just under the bath surface existing below the bath surface can be generated in a thickness of 100 mm or longer. The circulating flow can decrease the reaction bath liquid temperature distribution to reduce the heat load concentration to the reaction vessel and can lower the maximum temperature in the reaction vessel at the same time, so that higher productivity than that in the conventional art is achieved. Furthermore, the phenomenon that the circulating flow having a thin thickness of 100 mm or less exists just under the bath surface of the reaction bath liquid in the conventional art is hitherto not known and is revealed by the inventors for the first time. The invention is characterized in that a means for enhancing the productivity effectively is found based on the fact. The following will describe the process of the invention in detail.

The action of the first invention is described with reference to FIG. 1.

Figure 2:
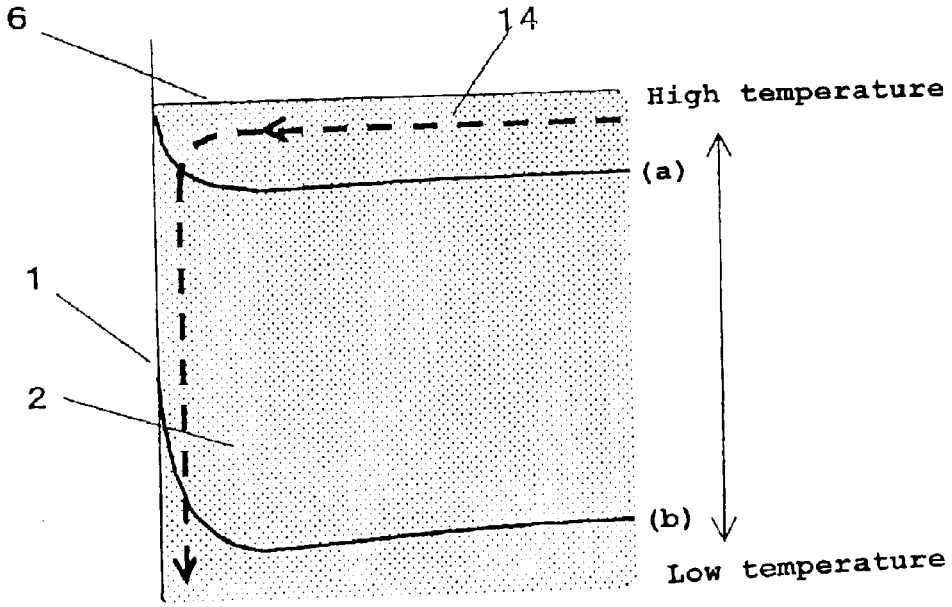
FIG. 2 is a conceptual illustration of a bath liquid temperature distribution in the first invention.

The reasons why the heat load is concentrated to the reaction vessel wall near the bath surface in the conventional art are, firstly, that a thin circulating flow exists just under the bath surface and heat tends to be kept in the circulating flow, and secondly, that both the bath liquid and over-bath gas have an extremely high temperature near the bath surface. Therefore, when the thickness 15 of the circulating flow just under the bath surface is increased, the temperature of the bath is homogenized at least in the range of the circulating flow, and also the area of the wall of the reaction vessel becomes larger, the wall being in contact with the circulating flow and being capable of direct removal of heat from the circulating flow. As a result, it is possible to diminish the difference between the temperature of the circulating flow and the average temperature of the bath. As shown in FIG. 2, when the difference between the temperature just under the bath surface and the average temperature of the bath liquid once decreases largely, the heat supply from a relatively high temperature region just under the bath surface to the vicinity of the wall of the cooling reaction vessel diminishes, so that the bath liquid near the inner wall of the reaction vessel has always a lower temperature than the central region of the reaction vessel has (isothermal lines (a) and (b) in FIG. 2). As a result, against a descending flow 14 along the wall of the reaction vessel from the bath surface, an upward resisting force based on the temperature distribution as shown in the conventional apparatus becomes difficult to occur, and hence the descending flow 14 can reach a deeper position, namely, it becomes possible to thicken the thickness 15 of the circulating flow just under the bath surface. That is, since the conventional apparatus originally possesses a strong potency for driving natural convection, i.e., strong cooling of the reaction vessel wall 1, the circulating flow 14 just under the bath surface can rapidly increase in the thickness 15 when the difference between the temperature under the bath surface and the average temperature of the bath is reduced.

As described above, in order to increase the thickness of the circulating flow just under the bath surface, it is effective to generate or enhance an upward flow 21 in part of the bath liquid by imparting a stirring force 17 which can overcome a decent-resistant force possessed by a high-temperature and low-density region just under the bath surface.

Figure 4:
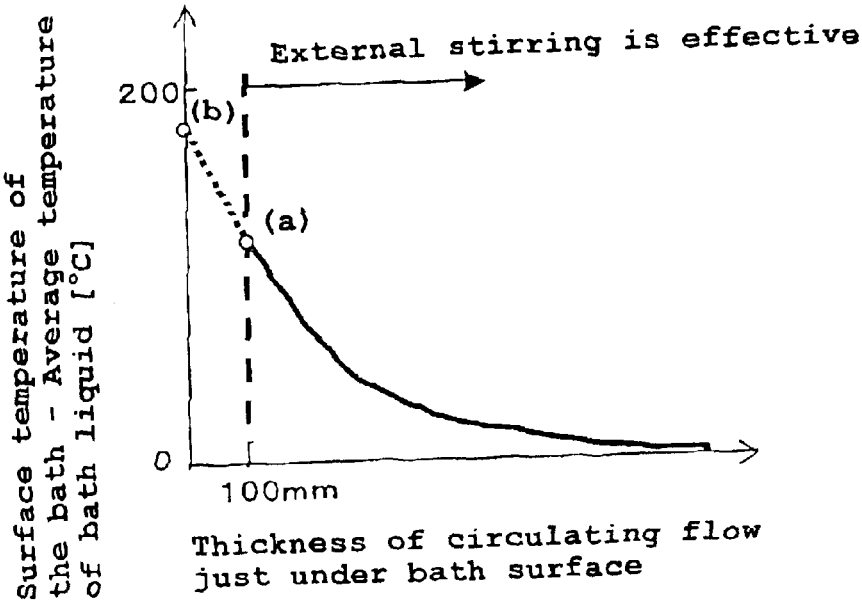
FIG. 4 is a conceptual illustration of a bath liquid temperature-homogenizing effect by a circulating flow just under the bath surface.

As a result of the precise investigation on a flow field in actual operation, the present inventors have found conditions of a stirring force-imparting position for extending and enhancing the circulating flow just under the bath surface by the stirring force. This is explained with reference to FIG. 4. In the case that no flow of the bath liquid exist and heat transportation is effected by heat transfer alone, namely, as a result of simulating the heat transportation within the bath by numerical analysis while the bath liquid is regarded as a homogeneous solid, a predictive value of the difference between the surface temperature of the bath liquid and the average temperature of the bath is about 200° C. (FIG. 4, point (b)). On the other hand, the thickness 15 of the circulating flow just under the bath surface in the conventional apparatus exists a little less than 100 mm based on the measured results in actual operation. Since the bath liquid transports heat relatively promptly in the circulating flow, a found value of the difference between the surface temperature of the bath liquid and the average temperature of the bath decreases to a little more than about 100° C. (FIG. 4, point (a)). This fact is one of powerful proofs that the circulating flow just under the bath surface in the conventional art has a certain effect on the decrease of the surface temperature of the bath liquid. However, the value of a little more than 100° C. as the difference between the surface temperature of the bath liquid and the average temperature of the bath in the conventional art is still too large from the viewpoint of preventing the heat load concentration to the reaction vessel.

When the thickness 15 of the circulating flow just under the bath surface is extended by imparting a stirring force externally to the conventional apparatus, the difference between the surface temperature of the bath liquid and the average temperature of the bath rapidly decreases as the thickness of the circulating flow increases and finally reaches nearly zero. However, in the case of an improperly imparted stirring force, e.g., a weak stirring force imparted to a position within 100 mm from the bath surface, the difference between the surface temperature of the bath liquid and the average temperature of the bath hardly decreases. The following will describe critical significance of the depth of 100 mm. Since titanium tetrachloride is allowed to free-fall from above the bath and to collide with the bath surface in the conventional art, the titanium tetrachloride drops also penetrate into the bath surface slightly to generate a stirring force. As a result of the investigation, it has been found that the stirring depth in the conventional art does not exceed 100 mm. Therefore, the impartment of the stirring force to the region at a depth of shallower than 100 mm do not cause a remarkable stirring enhancing effect unless the stirring force is sufficiently larger than the stirring force spontaneously generated in the conventional art. On the other hand, since such limitation does not exist in the case of the impartment of the stirring force to the position, where the dropping does not reach in the conventional art, at a depth of more than 100 mm below the bath surface, a stirring effect having a strong correlation with the imparted stirring force is obtained. In the case that the temperature difference between the bath liquid surfaces is not improved by stirring, the thickness of the circulating flow just under the bath surface also remains at a value near to the thickness in the conventional apparatus. That is, the temperature homogenization of the bath liquid is first realized when the thickness of the circulating flow just under the bath surface exceeds 100 mm which is the maximum value in the conventional apparatus. When this fact is more clearly defined for industrial application, the fact can be expressed as "to generate or extend or enhance an upward flow rate of the reaction bath liquid in a time-average manner in part of the region at a depth of more than 100 mm below the bath surface of the reaction bath liquid included in the circulating flow just under the bath surface". The inventors have found that the thickness of 100 mm as the thickness of the circulating flow just under the bath surface is a universal value in the conventional art, that is, the value is not exceeded in a wide range of operating conditions, for example, the range of dropping amount of 5 to 500 $kg/m^2 \cdot hr$, the range of average bath temperature of 800 to 1000° C., and the range of vessel diameter of 1 to 3 m.

Figure 5:
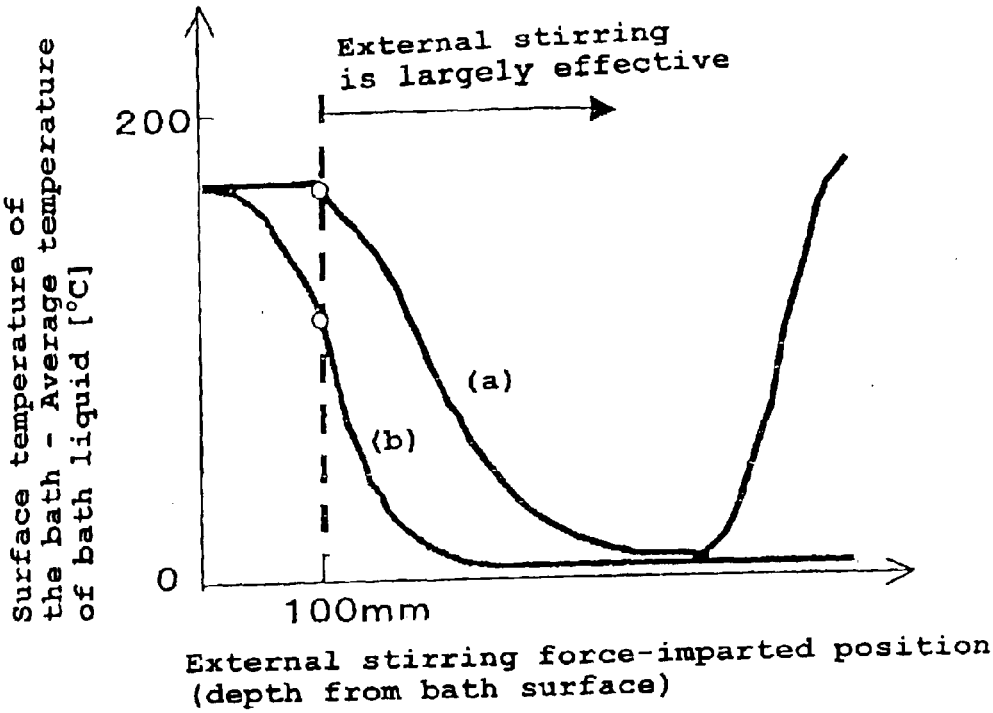
FIG. 5 is a conceptual illustration of a bath liquid temperature-homogenizing effect by an external stirring force-imparting position.

The following will describe a specific stirring force-imparting position for enhancing the thickness 15 of the circulating flow just under the bath surface with reference to FIG. 5. Based on the calculation results using the measured results of the bath flow and bath temperature in actual operation, about several tens N of a driving force based on natural convection is imparted to just under the bath surface in the conventional apparatus and the thickness 15 of the circulating flow just under the bath surface of 100 mm or less is maintained. Therefore, when a stirring force sufficiently larger than the driving force by natural convection, for example, 10000 N is imparted externally, extension of the circulating flow just under the bath surface is attained and, as a result, a decreasing effect of the difference between the surface temperature of the bath liquid and the average temperature of the bath is obtained (FIG. 5, line (b)). In this case, even when the stirring force-imparted position is within 100 mm under the bath surface, an upward stream is generated in the depth range of more than 100 mm below the bath surface, which means extension of the circulating flow just under the bath surface. In the case of the same stirring-imparting force, the deeper the stirring force-imparted position is, the higher the bath liquid temperature-homogenizing effect is. On the other hand, when a small stirring force of about several N is imparted to the bath liquid, the influence of the stirring force on the bath liquid temperature-homogenizing effect largely varies depending on the depth of the position to which the stirring force is imparted. (FIG. 5, line (a)). First, in the case that the stirring force-imparted depth is within 100 mm from the bath surface, a driving force of natural convection which is far larger than the stirring force is acting on the same region and the effect of the imparted stirring force is an influence of only several % increase of the driving force of natural convection, so that no remarkable stirring-enhancing effect is obtained. Next, in the case that the stirring force is imparted to the region at a depth of slightly deeper than 100 mm, as the imparted position becomes deep, the thickness of the circulating flow just under the bath surface is rapidly extended and the difference between the surface temperature of the bath liquid and the average temperature of the bath decreases. Thus, a remarkable stirring enhancing effect is exhibited. The reason why such a small stirring force influences largely on the thickness of the circulating flow just under the bath surface is as follows. Namely, first, since the bath liquid in a relatively low temperature region below the circulating flow just under the bath surface ascends to reach the bath surface by the stirring force, the average temperature of the bath surface slightly decreases. Next, since the heat entering into the vicinity of the reaction vessel into which the bath liquid from the bath surface flows by the circulating flow just under the bath surface decreases by the decrease of the average temperature of the bath surface, the descending circulating flow along the inner wall of the reaction vessel can go down to a deeper position. Furthermore, as a result of the elongated flow along the inner wall of the reaction vessel which is a main heat-removing part of the circulating flow just under the bath surface, a series of extending process of the circulating flow just under the bath surface may functions wherein the circulating flow just under the bath surface near the inner wall is further cooled and then transported again to the vicinity of the bath surface by the circulating flow and hence the average temperature of the bath surface all the more decreases. That is, since the stirring force imparted in this depth range only works as a trigger for allowing the driving force of natural convection to act efficiently on the bath temperature homogenization, a stirring-enhancing effect can be exhibited even by a relatively small force. However, in the case that the position to which a small stirring force of about several N is imparted is set at a further deeper position, e.g., a deep position in the bath at a depth of 2 m or more from the bath surface, an upward flow formed by this stirring force is no longer incorporated with the circulating flow just under the bath surface and becomes part of a circulating flow 16 at a deep position in the bath. As a result, the stirring force hardly influences the thickness of the circulating flow just under the bath surface and the stirring-enhancing effect on the bath liquid again disappears.

A specific value of the stirring force required for extending the thickness 15 of the circulating flow just under the bath surface cannot be determined so simple as in the case of the stirring force imparting position. This is because a minimum value of the stirring force at which the bath liquid temperature-homogenizing effect starts to be exhibited varies within a very wide range depending on the conditions such as the temperature distribution in the bath, the position and form of imparting the stirring force, and cooling of the reaction vessel, although it is true that the large stirring force tends to strengthen the stirring enhancing force. For example, at imparting the stirring force to the conventional apparatus, there is observed a difference of several tens to several hundreds times in required minimum stirring force in the comparison between the case that stirring is started before the chemical reaction to form a thick circulating flow just under the bath surface beforehand and the case that the thickness of the circulating flow is tried to extend by the stirring force after a high temperature region just under the bath surface is stably formed. Therefore, the stirring force to be imparted should be suitably set depending on the situation of bath temperature homogenization observed in actual operation. For example, in the case of the bath liquid where no heat enters from the bath surface and a temperature distribution hardly exists, a large single circulating flow can be formed over the whole bath liquid by imparting several N of the stirring force, but in the case that titanium tetrachloride is dropped at a rate of 250 $kg/m^2 \cdot h$, the stirring force of about several tens to several hundreds N is required for the formation of a large circulating flow just under the bath surface.

Figure 3:
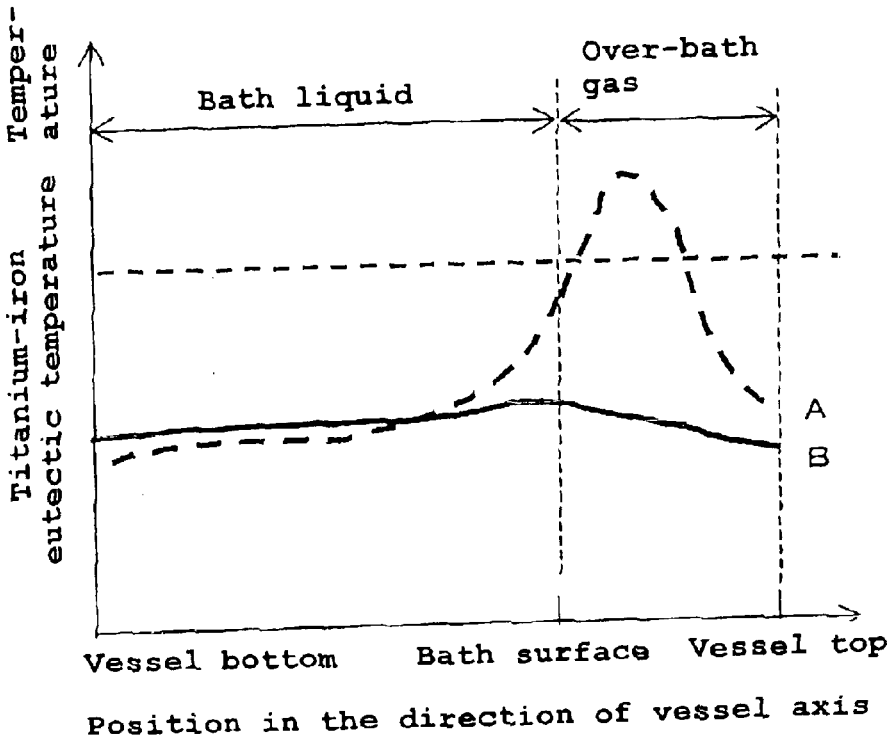
FIG. 3 is a conceptual illustration of a bath liquid temperature distribution in the axial direction of the vessel in the first invention.

FIG. 3, line A shows a bath liquid temperature distribution at the maximum dropping flow rate of titanium tetrachloride in the conventional art, and FIG. 3, line B shows a bath liquid temperature distribution at the same dropping rate when the first invention is applied. In the case of the conventional art, a high temperature part is converged at a position just under the bath surface and a factor of limiting the maximum dropping flow rate is that the maximum temperature at the part should be equal to or lower than the titanium-iron eutectic temperature of about 1080° C. On the other hand, in the bath liquid temperature distribution of the first invention at the same dropping rate, the average temperature of the bath liquid is a value similar to that in the conventional art but the maximum temperature decreases to about 800° C. that is largely lower than the titanium-iron eutectic temperature. At that time, a stirring force-imparting condition corresponds to 10 N at the position of 300 mm below the bath surface. Since there is a room until an upper limit of bath temperature, the dropping flow rate of titanium tetrachloride can be increased in the first invention as compared with the conventional art.

For realizing the first invention, the operation quantity of a bath liquid-stirring apparatus may be controlled so as to maintain a predetermined thickness of the circulating flow just under the bath surface by determining the thickness 15 of the circulating flow just under the bath surface by measuring a bath liquid rate distribution and feeding back the thickness to the operation quantity. Alternatively, the relationship between the operation quantity and working conditions of the bath liquid-stirring apparatus and the thickness of the circulating flow just under the bath surface is determined beforehand and the operation quantity of the bath liquid-stirring apparatus may be set depending on the value determined from the relationship so as to maintain a required range of the thickness of the circulating flow just under the bath surface at individual setting in actual operation.

The "upward" flow herein merely means a flow of either direction of upward or downward which is the vertical direction of the vessel and the stirring force to be imparted is not necessarily "upward". This reason is as follows. That is, in a flow within a closed vessel as is the case of the invention, when a time-average "downward" flow is generated within part of the bath liquid, a time-average "upward" flow generates reversely at any position in the same horizontal cross-section since the integral value of the rate distribution passing within this cross-section must be zero in a time-average manner. However, as a result of the investigation by the inventors, it has been found that the convergence of the "upward" stirring force in a narrow range of the bath liquid is effective for enhancing stirring by a little imparted force, so that it is generally advantageous to impart a stirring force "upward" unless there exist limitations on facilities and the like. Moreover, the extension or enhancement of the circulating flow just under the bath surface by generating or enhancing an upward flow 21 at part of the region in the bath liquid substantially means that the "upward flow" 21 forms part of the circulating flow just under the bath surface. This is because the inventors have found that, even when the circulating flow 16 at a deep position in the bath is formed or enhanced by generating the upward flow at a position irrelevant to the circulating flow just under the bath surface, such a circulating flow hardly contributes the extension of the circulating flow just under the bath surface.

Moreover, in the present specification, the "circulating flow" in the "circulating flow" just under the bath surface means that a time average flow of the bath flow(s) is circulating. This is because there is frequently observed the case that a number of smaller circulating flows exist in the circulating flow just under the bath surface in a moment of time and a large circulating flow seems not to be formed. However, even in such a flow where a large circulating flow seems not to be formed apparently, the inventors have found that a large circulating flow can be clearly recognized just under the bath surface when a rate distribution of the bath flow is measured in a time-average manner within several minutes at longest and the circulating flow accelerates heat transportation between the bath surface and the inside of the circulating flow.

Furthermore, "just under the bath liquid" means a range where the circulating flow perpendicular to the bath surface exists, the range being nearest to the bath surface. For example, it corresponds the region of the depth range from the bath surface to 100 mm below the bath surface in the conventional art.

Additionally, "reaction bath liquid surface" means the interface between the reaction bath liquid layer which is stored in the reaction vessel and the over-bath gas layer in the vessel. In the case that there is no room of a possible misunderstanding in the context, it is simply called "bath surface".

In addition, "part" in "in part of the region at a depth of more than 100 mm below the bath surface of the reaction bath liquid" means the region in the reaction bath liquid, which has at least 0.1% or more area of the bath surface area at a cross-section perpendicular to the bath surface. The ground of the value of 0.1% is based on the fact that, even when an upward reaction bath liquid flow rate is generated in a narrower region than the value in a time-average manner, a bath temperature-homogenizing effect by extending the circulating flow just under the bath surface is not necessarily exhibited owing to a too small momentum of the flow. With regard to the length of the region perpendicular to the bath surface, since required length of the region largely varies depending on a stirring force-imparting apparatus, the length is not particularly defined.

Moreover, in the first invention, "to extend" the circulating flow just under the bath surface means to increase the thickness of the circulating flow or to increase the maximum flow rate in the circulating flow (hereinafter, this case is sometimes referred to as "to enhance"), and "to generate" means to induce a circulating flow by imparting a stirring force to the bath liquid having a small temperature distribution at the start of the reduction reaction. Each of "to extend", "to enhance", and "to generate" has a different concept and strictly, they come not always into effect at the same time. However, in many cases, all of "to extend", "to enhance", and "to generate" mean a tendency to increase the effect by imparting the stirring force, so that the existence of an "extending" effect of the circulating flow means co-existence of an "enhancing" effect and/or a "generating" effect in the invention unless otherwise stated.

The following will explain the action of the second invention. First, an essential point of the difference between the invention and the conventional art is described. In the conventional art, the operating condition of reaction bath liquid temperature is lower than 1080° C. which is the eutectic temperature of the vessel steel and titanium and the operation just under the upper limit temperature is directed with regard to the reaction bath liquid temperature. This is because elevation of the reaction bath liquid temperature is unavoidable for enhancing the productivity since a stirring force is not imparted in the conventional operation. On the other hand, the second invention is characterized in that the upper limit of the operating condition of surface temperature of the bath liquid is newly set at 950° C. on the premise that a stirring force is imparted to the reaction bath liquid, and thereby, the reaction quantity in the over-bath gas layer, which is a predominant cause of the heat load concentration in the reaction vessel, is diminished to reduce the heat load concentration to the reaction vessel and also a maximum temperature in the reaction vessel is lowered, and finally both of a high productivity and extension of vessel life are realized. Furthermore, a phenomenon that the heat load is concentrated to the reaction vessel near the bath surface because main chemical reaction is a reaction in the over-bath gas layer in the case that the surface temperature of the bath liquid is a high temperature exceeding 950° C. has been itself also hitherto not known and has been revealed for the first time by the inventors. The characteristic feature of the invention is that a means for efficiently realizing both the enhancement of productivity and the extension of vessel life is found out based on the fact. The following will describe the invention in detail.

Figure 7:
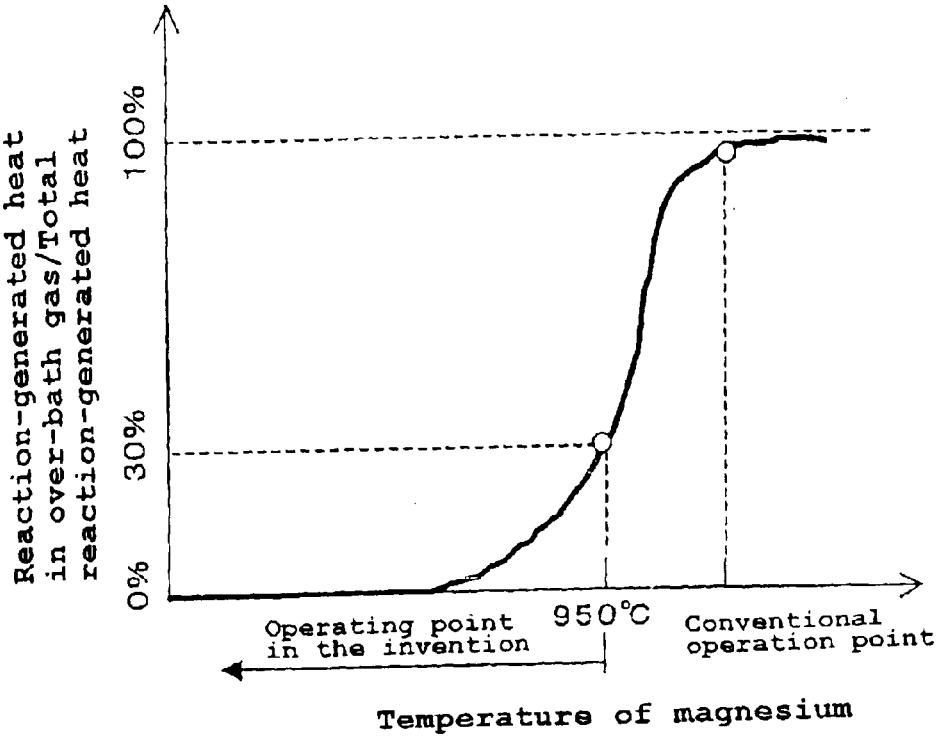
FIG. 7 is a comparative conceptual illustration between a conventional apparatus and the first invention with regard to reaction-generated heat.

The second invention relates to a process for suppressing the reaction-generated heat in the over-bath gas layer on the premise of the first invention. As described above, the reason why the ratio of the reaction -generated heat in the over-bath gas becomes high in the conventional art is that magnesium vaporizes into the over-bath gas layer owing to a high bath liquid surface temperature of 1000° C. or higher and the reduction reaction therein, i.e., the reaction in the over-bath gas layer occurs to a large extent. In the conventional art, there exists no means for actively homogenizing bath temperature and the operation of the dropping flow rate of titanium tetrachloride is directed to a maximum productivity, so that it is an unavoidable operating condition to set always the surface temperature of the bath liquid at a value just under the upper limit temperature. On the other hand, in the second invention, utilizing the possible control of the surface temperature of the bath liquid to a lower temperature side by imparting the bath liquid-stirring force according to the first invention, the heat load to the inner wall of the reaction vessel above the bath is reduced by setting the surface temperature of the bath liquid within a range of operation conditions wherein the ratio of the reaction rate in the over-bath gas layer to the total reaction rate is sufficiently small and the reaction in the over-bath gas layer is not a main route of the reaction. The operation wherein the reaction in the over-bath gas layer is not a main route of the reaction is determined as a condition that the "reaction-generated heat in the over-bath gas layer/total reaction-generated heat" shown in FIG. 7 is 30% or less. The reason why the value of 30% is particularly selected is that, as shown in FIG. 7, when the reaction-generated heat in the over-bath gas layer exceeds this ratio, a slight elevation of temperature causes a rapid increase of the ratio of the reaction-generated heat in the over-bath gas layer and thus this reaction becomes a main reaction route, so that it becomes difficult to control the surface temperature of the bath liquid.

Figure 6:
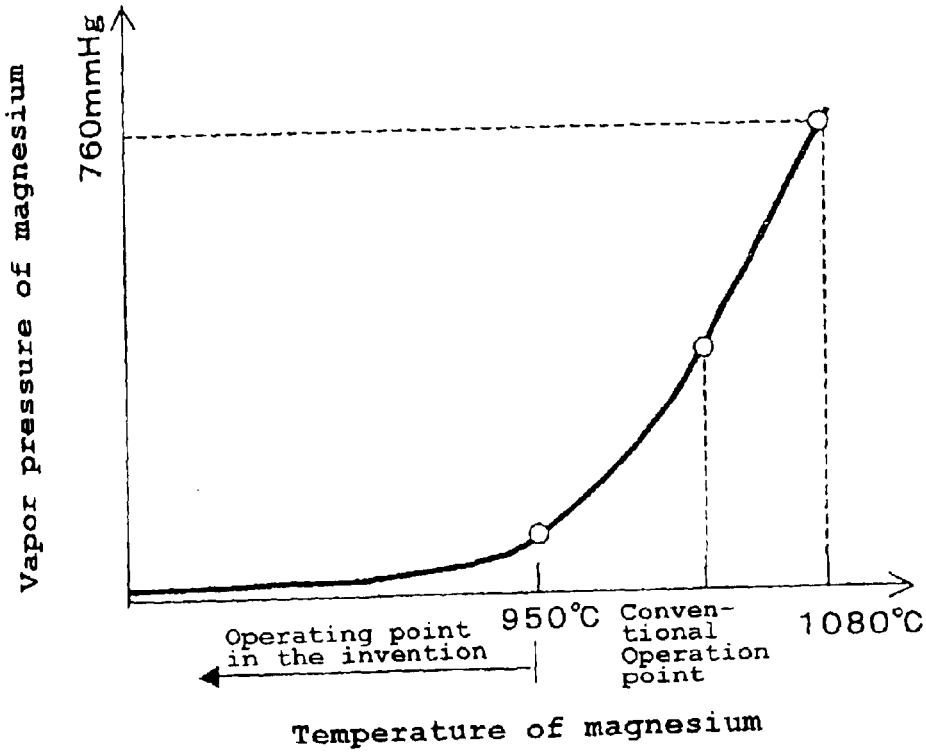
FIG. 6 is a comparative conceptual illustration between a conventional apparatus and the first invention with regard to the vapor pressure of magnesium.

In the second invention, a specific condition for setting the "reaction-generated heat in the over-bath gas layer/total reaction-generated heat" at 30% or lower is to maintain the maximum temperature on the bath surface at 950° C. or lower. As shown in FIG. 6, at a temperature equal to or lower than this temperature, magnesium vapor is sufficiently low as compared with the operating condition in the conventional apparatus, the "reaction-generated heat in the over-bath gas layer/total reaction-generated heat" is maintained at 30% or lower as shown in FIG. 7. The inventors have found that the condition of maintaining the maximum temperature on the bath surface at 950° C. or lower is effective in a wide range of operating conditions, for example, in the range of titanium tetrachloride-dropping flow rate of 5 to 500 $kg/m^2 \cdot hr$ and is a characteristic value.

By decreasing the ratio of the reaction-generated heat in the over-bath gas layer, the reduction reaction of titanium tetrachloride is mainly constituted by the surface reaction on the bath surface. Most of the heat generated in the surface reaction is transferred into the bath liquid side which is more heat-transferable. Since the heat transferred into the liquid side is promptly transported to a deep position of the bath by the effect of the first invention, there is no possibility that the bath temperature is elevated locally to an extremely high temperature or the heat load is concentrated to the reaction vessel in the bath. Moreover, as shown in FIG. 3, an extremely high temperature part caused by heat generation in the over-bath gas layer is present in the over-bath gas layer in the conventional art (FIG. 3, Line A), but there is no extremely high temperature part in the over-bath gas layer owing to the originally little heat generation in the over-bath gas layer in the second invention (FIG. 3, Line B) and hence the heat load to the inner wall of the reaction vessel above the bath is reduced. The inventors have confirmed that the heat load concentration to the reaction vessel can be suppressed to a level similar to the level in the conventional art by setting the maximum temperature of the bath surface always at 950° C. or lower even when titanium tetrachloride is dropped at a dropping flow rate two times larger than the maximum dropping flow rate in the conventional art. As described above, it is enabled to form no extremely high temperature region in both of the bath liquid and over-bath gas by setting the surface temperature of the bath liquid at a temperature lower than the temperature used in the conventional art. This is based on the findings that the reduction reaction in the conventional art is mainly constituted by the reaction in the over-bath gas, and the reaction in the over-bath gas layer is drastically accelerated as magnesium vapor pressure increases, i.e., the surface temperature of the bath liquid is elevated, and especially this effect becomes remarkable when the surface temperature of the bath liquid exceeds 950° C., the findings having been found for the first time by the inventors. In this connection, it is shown in the first invention that the temperature homogenization of the reaction bath liquid is advantageous for improving the productivity. However, in view of the liquid temperature homogenization, desirable upper limit of the average temperature of the reaction bath temperature is 950° C. which is equal to the upper limit of the surface temperature of the reaction bath liquid.

In addition, since the bath can be effectively cooled thanks to the effect of the first invention, it is possible to set the bath average temperature at a low temperature in the case of a titanium tetrachloride-supply flow rate similar to that in the conventional art. This is an advantageous operating condition in view of the reaction vessel life and product titanium contamination. However, in actual operation, when the bath average temperature decreases to lower than 770° C., the region having a temperature lower than the melting point of magnesium locally appears in the reaction vessel, which may arise problems of decreased flowability of the bath and difficulty in the discharge of magnesium dichloride. Accordingly, the inventors have found that the bath average temperature should be maintained at 770° C. or higher. For example, when the bath temperature is set at 770° C. on average, the life of the reaction vessel can be extended 1.5 times that in the conventional art. The summary of the action of the second invention is that the productivity of twice that in the conventional art or improved product quality and apparatus life can be secured by setting the average temperature of the bath liquid at 770° C. or higher and the maximum temperature on the bath surface at 950° C. or lower. In this connection, the desirable lower limit of the surface temperature of the reaction bath liquid is 770° C. for the reason the same as that in the case of the lower limit of the average temperature of the reaction bath liquid.

The "average temperature of the reaction bath liquid" herein means a space average temperature over the whole reaction bath liquid in the reaction vessel. Moreover, the "surface temperature of the reaction bath liquid" means a temperature at bath liquid side of the interface between the bath liquid and the over-bath gas layer. Both of the surface temperature of the reaction bath liquid and the average temperature of the reaction bath liquid can be obtained by inserting a temperature-measuring apparatus such as a thermocouple onto the bath surface and into the bath and then measuring each temperature therein. The surface temperature of the reaction bath liquid and the average temperature of the reaction bath liquid can be set by controlling incoming and outgoing heat of the reaction vessel through feedback of measured values of the bath liquid temperature to a heating and cooling apparatus of the reaction vessel to maintain the bath temperature in a predetermined range. Alternatively, it can be achieved by determining the relationship between the characteristics of the heating and cooling apparatus and operation conditions of the reaction vessel and the bath temperature beforehand and changing the incoming and outgoing heat of the reaction vessel so as to achieve a predetermined range of the bath temperature at the time of individual setting in actual operation using the value determined from the relationship as a setting value for the heating and cooling apparatus of the reaction vessel.

Figure 8:
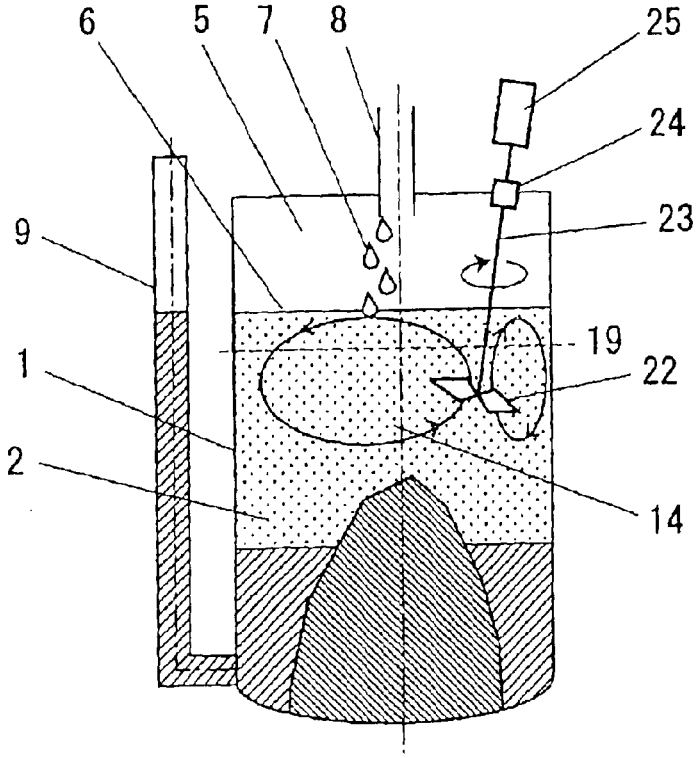
FIG. 8 is a conceptual illustration of the third invention.

The following will describe the third invention with reference to FIG. 8. A screw 22 is inserted into the reaction bath liquid 2 in the process of either the first invention or the second invention. The screw 2 is connected with a transmission shaft 23, the transmission shaft 23 is lead out of the reaction vessel, and a rotating force is transmitted to the screw by an actuator 25 such as an electric motor. The transmission shaft 23 is a movable apparatus and thus a sealing device 24 for preventing penetration of outside air into the reaction bath liquid is placed at the part where the transmission shaft passes through the reaction vessel. A stirring force is imparted to the bath liquid by rotating the screw 22, and a temperature-homogenizing effect of the bath liquid is obtained by allowing the screw to impart a stirring force having a power capable of extending the thickness of the circulating flow just under the bath surface to the bath liquid. The screw is placed in the range of 100 mm to 2000 mm below the bath surface near the axis of the reaction vessel and the condition for obtaining an effect of extending the thickness of the circulating flow just under the bath surface by a minimum stirring force is to set the stirring force in the perpendicular and upward direction.

At realizing the third invention, the thickness of the circulating flow just under the bath surface may be controlled so as to achieve a predetermined thickness by determining the thickness from the measured values of the bath flow rate distribution and feeding back the thickness to the operation quantity of the stirring device. Alternatively, the invention may be realized by determining the relationship between the operation quantity and operating condition of the stirring device and the thickness of the circulating flow beforehand, determining the operation quantity of the stirring device from the relationship so as to achieve a desired range of thickness of the circulating flow just under the bath surface, and setting the quantity at the time of individual setting in actual operation.

Figure 9:
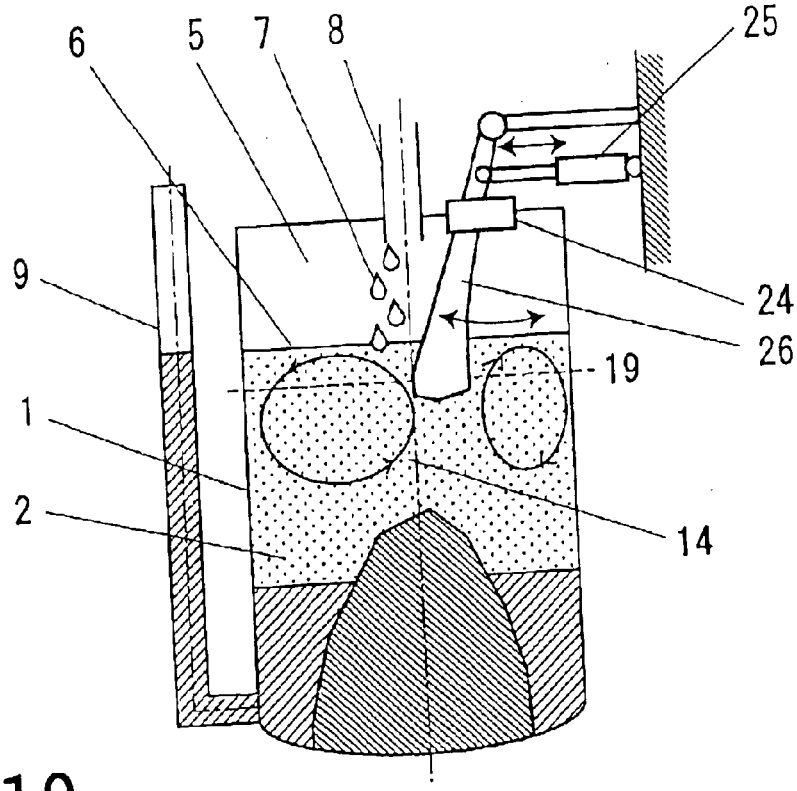
FIG. 9 is a conceptual illustration of the forth invention.
Figure 10:
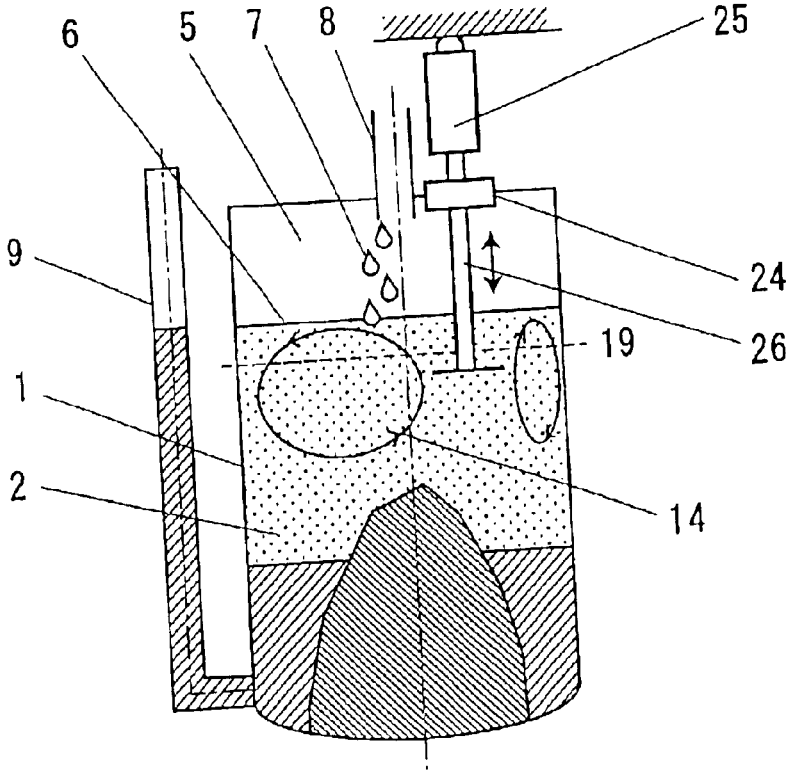
FIG. 10 is a conceptual illustration of the forth invention.

The following will describe the fourth invention with reference to FIG. 9. A stirring bar 26 which is a rod-like or spatular structure is inserted into the reaction bath liquid in any of the processes of the first invention to the third invention. The stirring bar 26 is connected with a rotatable supporting point and oscillates or rotates in the bath to stir the bath liquid and to homogenize the temperature of the bath liquid. The supporting point of the stirring bar may be part of the reaction vessel or may be present outside the vessel passing through the reaction vessel. However, in the case that the supporting point is present outside the reaction vessel, a sealing device 24 is necessary at the part where the stirring bar passes through the reaction vessel. By the oscillation of the stirring bar, a flow in the radial direction of the vessel or a flow in the peripheral direction is mainly generated in the bath but a flow in the axial direction just under the bath surface is also generated or enhanced. This is because part of the flow in the radial direction formed by the stirring bar also generates the component in the axial direction of the vessel at the time when the flow turns at the wall surface of the vessel and also is a result of the turbulent energy supplied by the stirring bar. It is effective to place the stirring bar in the range of 100 to 2000 mm below the bath surface near the axis of the reaction vessel. The shape of the end of the stirring bar is not limited to bar-like or spatular shape as far as it can efficiently transfer the stirring force to the bath liquid, and may be a variety of shapes such as a flat shape having an opening, a ribbon-like shape, and a spiral shape. As one example, FIG. 10 shows an embodiment wherein a stirring bar 26 connected with a disk at the end is reciprocated upward and downward. FIG. 10 shows an apparatus wherein the stirring bar is connected with an actuator 25 placed outside the reaction vessel and a stirring force in the axial direction is imparted to the bath liquid by the reciprocation of the disk upward and downward in the bath. Since the fluid resistance of a disk is proportional to square of a disk-moving rate, an upward stirring force can be imparted in a time-average manner by setting the rate rapid at the ascent of the disk and slow at the descent of the disk. The effect of extending the thickness of the circulating flow just under the bath surface by the fourth invention can be confirmed by the same method as the measurement of bath flow rate described in the paragraph of "Background Art".

At realizing the third invention, the thickness of the circulating flow just under the bath surface may be controlled so as to achieve a predetermined thickness by determining the thickness from the measured values of the bath flow rate distribution and feeding back the thickness to the operation quantity of the stirring device. Alternatively, the invention may be realized by determining the relationship between the operation quantity and operating condition of the stirring device and the thickness of the circulating flow beforehand, determining the operation quantity of the stirring device from the relationship so as to achieve a desired range of thickness of the circulating flow just under the bath surface, and setting the quantity at the time of individual setting in actual operation.

Figure 11:
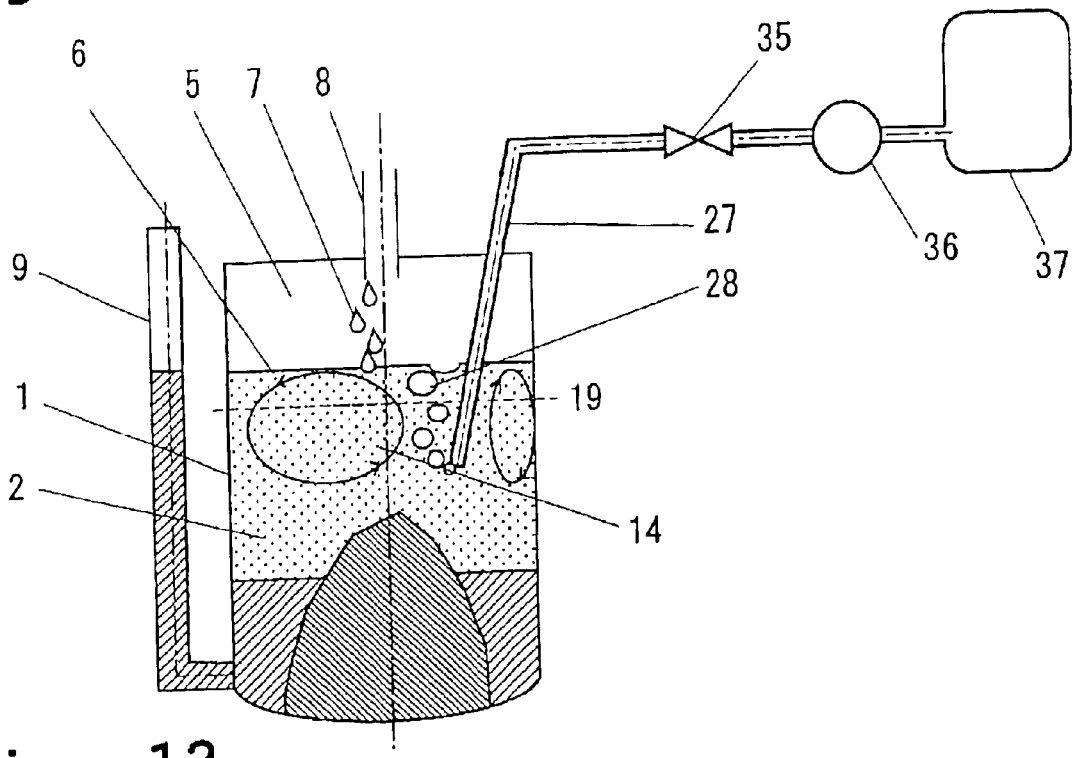
FIG. 11 is a conceptual illustration of the fifth invention.

The following will describe the fifth invention with reference to FIG. 11. In any of the processes of the first invention to the fourth invention, a stirring gas-supply pipe 27 passing through the outside of the reaction vessel is inserted into the reaction bath liquid 2, a gas outlet is provided at the bath-dipped part of the stirring gas-supply pipe 27, and a gas non-reactive with the reaction bath liquid is discharged into the reaction bath from the outlet. The gas non-reactive with the reaction bath liquid herein means an inert gas such as argon, or any gas having a relatively low reactivity with the bath liquid and may be regarded to be substantially non-reactive with the bath liquid, e.g., nitrogen, carbon monoxide, carbon dioxide, or hydrogen, or an organic gas such as methane. For discharging a gas non-reactive with the reaction bath liquid, the stirring gas-supply pipe outside the reaction vessel is connected with a gas bomb 37 and a compressor 36, back-pressured, and provided with a regulating valve 35 for gas flow rate or gas pressure. The discharged gas ascends in the bath while forming bubbles 28 in the bath or a vapor pillar passing through the bath to the bath surface. A stirring force can be imparted to the bath liquid by the driving force imparted to the bath liquid as the bubbles 28 ascend and the driving force based on shear stress imparted to the bath liquid surrounding the vapor pillar by the gas ascending in the vapor. Since the discharged inert gas is finally accumulated in the over-bath gas, the discharged gas should be suitably released into the outside of the reaction vessel. Therefore, the amount of the discharging gas should be minimized from the viewpoint of cost. In addition, magnesium actively vaporizes in the bubbles released in the bath and the bubbles containing a large amount of magnesium vapor are released into the over-bath gas layer. As a result, the magnesium vapor reacts with the titanium tetrachloride vapor in the over-bath gas layer and hence the temperature of the over-bath gas is elevated to increase heat load to the inner wall of the reaction vessel above the bath surface. Therefore, the amount of the discharging gas should be minimized also from the viewpoint of the heat load concentration to the reaction vessel. As a result of precise investigations on the discharge of an inert gas into the bath for applying to actual operation, the inventors have found that the effect of extending the thickness of the circulating flow 14 just under the bath surface, i.e., the bath liquid temperature-homogenizing effect may be obtained at a relatively small gas-discharging amount, e.g., from 0.001 to 0.1 Nl/second by setting the gas outlet in the range of 100 to 2000 mm below the bath surface in the bath. The reasons why a large bath liquid stirring effect is obtained with such a small amount of gas are as follows. Firstly, as already described, since the stirring force to be imparted herein only acts as a trigger for extending the circulating flow just under the bath surface, a small force is sufficient. Secondly, it is generally effective to make the gas form in the bath not a gas pillar but bubbles and set the bubble size as small as possible in order to impart a large stirring force at a little discharging gas flow rate, and in the invention, the discharged gas can be ascended as fine bubbles in the bath by discharging the gas in the range of 100 to 2000 mm below the bath surface and carrying out the operation in the range of a gas supply outlet size of 1 to 50 mm and in the range of a discharging gas flow rate of 0.001 to 0.1 Nl/second. In FIG. 11, the stirring gas-supply pipe is a straight pipe and is inserted with a slope toward the bath surface, but the shape of the pipe may be a bent pipe, the stirring gas outlet may be present not only at the pipe end but also at the side surface of the pipe, and the number of the opening may be one or more. Furthermore, the main pipe may be branched to other pipe(s) and the stirring gas may be discharged from the opening of the other pipe(s), or a nozzle may be provided at the end of the opening. With regard to these pipe shape conditions, it is suitable to select the most efficient conditions depending on the particularity of individual apparatus to be employed for engineering actual equipment. Moreover, the discharging flow rate of argon gas may also be suitably set so that the gas ascending in the bath forms not a gas pillar but bubbles. The vapor form in the bath can be determined for example by inserting two electrodes into the bath and measuring the change of electric resistance between the electrodes. This is a method for recognizing the presence of the vapor between the electrodes utilizing the fact that the electric resistance of vapor is remarkably large as compared with the bath liquid. When the vapor is bubble shape, the resistance decrease by the passage of the bubbles only occurs intermittently but a continuous period of low resistance is detected over a period of at least several seconds in the case of the electrodes present in a vapor pillar.

The following will describe the summary of the difference between the sixth invention and the conventional art. In both the conventional art and the invention, titanium tetrachloride is supplied from above the reaction bath liquid and also a circulating flow is formed under the bath surface. The difference is as follows. In the conventional art, liquid titanium tetrachloride to be dropped is in an unstable two-phase state at a normal pressure just before the outlet of the supply pipe and reaches dispersively the bath surface as low-speed free-fall liquid drops, so that liquid titanium tetrachloride does not enter deep into the bath and the thickness 15 of the circulating flow just under the bath surface is kept at 100 mm or less. On the other hand, in the invention, by imparting a high backpressure to liquid titanium tetrachloride to be supplied and narrowing the liquid with a nozzle just before the outlet to rectify the flow, titanium tetrachloride is injected while kept as a single-phase flow even just before the discharge from the nozzle and collides with the bath surface at a high speed, whereby titanium tetrachloride is allowed to reach a depth exceeding 100 mm below the bath surface to increase the thickness 15 of the circulating flow just under the bath surface to a thickness exceeding 100 mm, which permits temperature homogenization of the bath liquid. The following will explain the invention in detail.

Figure 12:
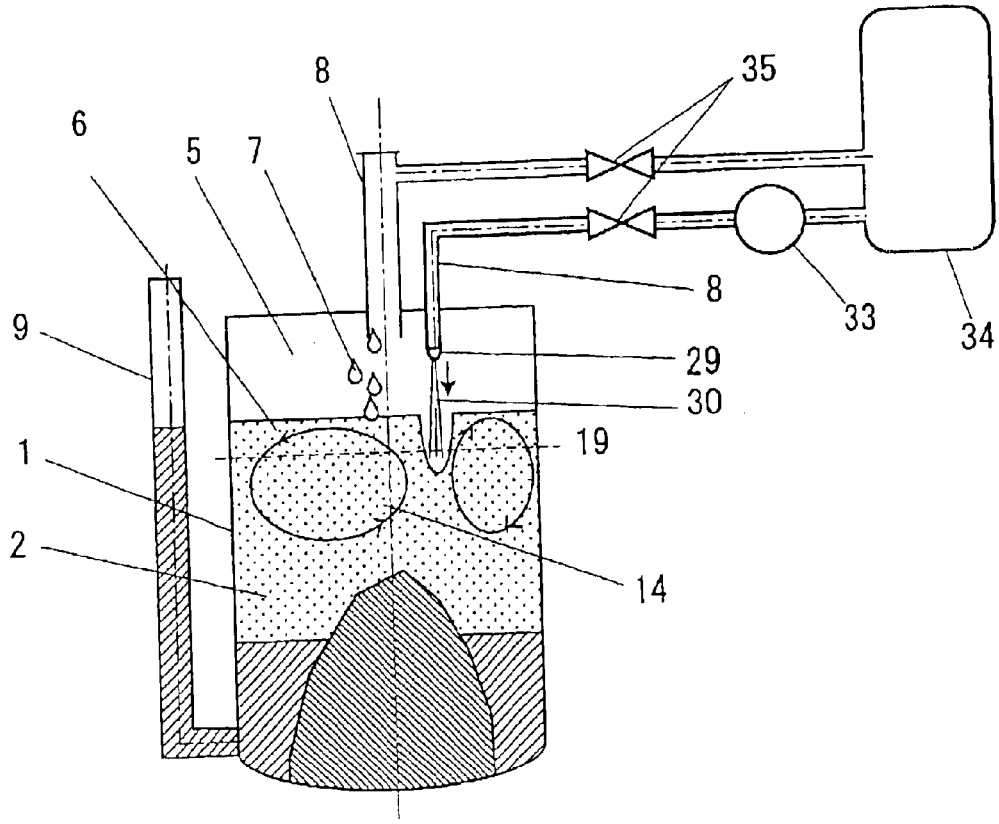
FIG. 12 is a conceptual illustration of the sixth invention.
Figure 13:
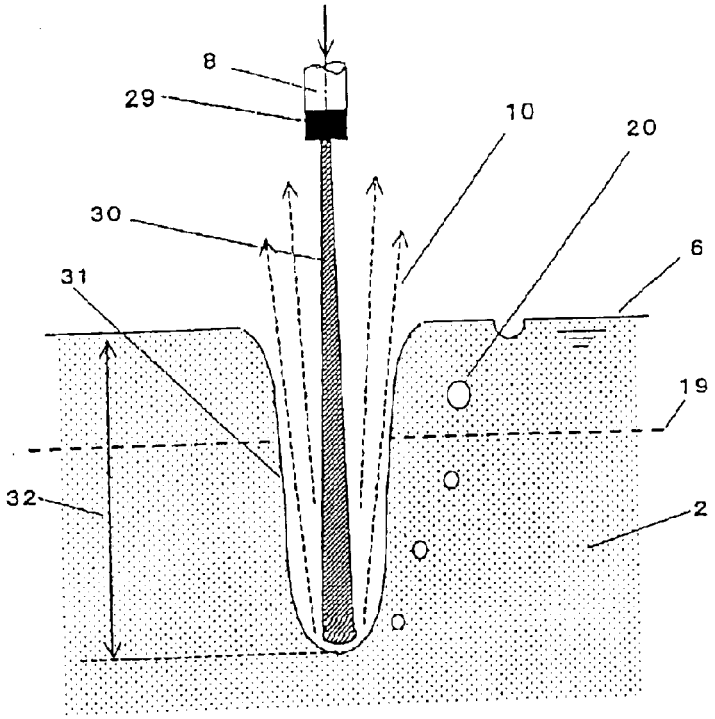
FIG. 13 is a conceptual illustration of a phenomenon at a titanium tetrachloride drop-falling part in the sixth invention.

The sixth invention will be described with reference to FIG. 12. On the premise of any of the first invention to the fifth invention, a back-pressured liquid titanium tetrachloride is injected to the bath surface 6 through a nozzle 29 placed toward the bath surface 6 above the bath surface 6 of the reaction bath liquid. In order to back-pressurize the nozzle 29, a titanium tetrachloride-supply pipe 8 is connected with a pump 33 and a liquid titanium tetrachloride tank 34 outside the reaction vessel, and a regulating valve 35 for gas flow rate or gas pressure is provided in the middle of the pipe. An injected liquid titanium tetrachloride jet flow 30 penetrate into the bath when reaches the bath surface 6, a cave-like titanium chloride vapor film 31 is formed around the jet flow in the bath. By allowing a vapor film-penetrating depth 32 from the bath surface, which is the deepest reaching distance of the cave-like titanium chloride vapor film 31 in the reaction bath 2, to reach a depth more than 100 mm below the bath surface, a bath liquid stirring-enhancing effect can be obtained and the thickness 15 of the circulating flow just under the bath surface increases. The angle of the nozzle central axis with the bath surface is not particularly defined but is suitably set so that the penetration depth 32 of the injected titanium tetrachloride from the bath surface can be sufficiently secured. The mechanism of obtaining the bath liquid stirring-enhancing effect will be described with reference to FIG. 13. The titanium tetrachloride-supply pipe 8 and the titanium tetrachloride-injecting nozzle 29 are filled with liquid titanium tetrachloride and a relatively large backpressure, e.g., hundreds of thousands Pa is imparted to them. The term "back pressure" called herein means a static pressure difference between outlet and inlet of the nozzle. In the sixth invention, the static pressure at the nozzle outlet is equal to the gas pressure in the reaction vessel, and is usually set at a pressure tens of thousands Pa higher than atmospheric pressure in order to prevent the penetration of outside air into the vessel. The inside of the pipe and nozzle shown here is always filled with liquid titanium tetrachloride and most of the backpressure is converted into momentum of the titanium tetrachloride jet flow. In the sixth invention, the discharged titanium tetrachloride jet flow 30 is either a single-phase liquid jet flow or a two-phase type jet flow which is an assembly of liquid drops, but in the case that the distance between the end of the nozzle and the bath surface is relatively short, e.g., 2000 mm or less, the jet flow may collide with the bath surface 6 with hardly damping the momentum imparted to the jet flow at the discharge. By this collision, the bath surface is expanded and the jet flow can reach a deeper position than the bath surface. At the end part of the jet flow, liquid titanium tetrachloride vigorously vaporizes to form the cave-like titanium chloride vapor film 31 between the jet flow and the bath liquid, and thereby direct contact and mixing of the jet flow and the bath liquid is inhibited. The titanium chloride gas (titanium tetrachloride vapor and gases of titanium lower chlorides as intermediary products) in the vapor film is partially absorbed through its reaction on the bath surface but the remainder is released into the over-bath gas. Since the flow rate of the gas released from the cave-like titanium chloride vapor film into the over-bath gas is extremely high, for example, several hundreds m/second, a strong shear stress is continuously imparted to the bath liquid surface of the cave-like titanium chloride vapor film. This is a first driving force which imparts an upward stirring force to the bath liquid. Other than this force, there exists a second driving force. This force occurs as follows. At the formation of the cave-like titanium chloride vapor film, in many cases, part of the vaporized titanium tetrachloride cannot be incorporated with the cave-like titanium chloride vapor film and is released into the bath as isolated bubbles, which ascend in the reaction bath. By the ascent of the isolated bubbles 20, an upward force is imparted to the bath liquid. When injecting conditions of titanium tetrachloride are set so that the penetration depth 32 into the bath is larger than 100 mm in a time-average manner, the inventors have found that a stirring force of several tens N can be easily obtained by the first and second driving forces and also an effect on the extension of the thickness 15 of the circulating flow just under the bath surface is achieved. As the penetration depth 32 into the bath increases, the effect of extending the thickness of the circulating flow just under the bath surface is rapidly enhanced. In this connection, the fact that the stirring effect by the high-pressure injection of a volatile liquid jet flow to the high temperature liquid surface as in the sixth invention is due to the first and second driving forces has been also found by the inventors for the first time.

As the other action of the sixth invention, with regard to the vapor film formed in the bath and titanium chloride gas in the vapor bubbles, when the penetration depth into the bath is large, e.g., 300 mm or more, not only the bath liquid temperature-homogenizing effect by the bath liquid stirring but also an effect of decreasing the release of titanium chloride gas into the over-bath gas are achieved since the reaction proceeds to a remarkable extent before titanium tetrachloride vapor is released into the over-bath gas. Since the decrease of the release of titanium chloride gas into the over-bath gas results in the decrease of the reaction quantity in the over-bath gas and on the bath surface, the ratio of the reaction in the over-bath gas layer to the total reaction further decreases and hence the heat load concentration to the wall of the reaction vessel near the bath surface is reduced. At the same time, by a gas bubbling effect, a surface film generated at the bath surface caused by reaction products is destroyed and the reaction efficiency on the bath surface is improved. As a result, it becomes possible to cope with a larger titanium tetrachloride-dropping flow rate.

The advantages of the sixth invention in comparison with the other bath liquid stirring methods are as follows. Firstly, there are no risk of contamination of formed sponge titanium mass caused by stirring the bath and no necessity of immersing the stirring bar, the titanium tetrachloride-supply pipe, and the inert gas-supply pipe in the bath liquid. Secondly, since a high-speed liquid drops are injected to the bath surface at supplying titanium tetrachloride from above the bath surface into the bath, a high collision pressure is easily obtained and a large penetration depth into the bath can be attained without generation of a large amount of droplets as compared with a gas-blowing method from above the bath. Thirdly, the equipment can be relatively simply constituted as compared with the other stirring methods.

The following will describe the difference with the conventional art. Firstly, just before the discharge of titanium tetrachloride into the reaction vessel, a high-speed single-phase flow is maintained in the invention but a low-speed double-phase flow is formed in the conventional art. The reason is that the discharging pipe size is so large as 20 mm or more from the viewpoint of prevention of blockage of the dropping pipe in the conventional art but the nozzle discharging size is so small as about 10 mm or less because the flow is narrowed by the nozzle in the invention. This is because the inner diameter of the nozzle should be sufficiently small as compared with the nozzle flow rate in order to fill always the inside of the pipe system and nozzle with liquid titanium tetrachloride. When the inner diameter of the nozzle is too large as compared with the nozzle flow rate, a liquid flow in the nozzle is momentally more stable in a two-phase flow state wherein a liquid flow passes only a part of the nozzle at a high speed and other part is filled with gas as compared with the case that the liquid uniformly slowly flows as a single-phase flow wherein the nozzle is filled with the liquid flow. Also, the nozzle flow rate is predetermined depending on the operating conditions, a maximum value of the inner diameter of the nozzle exists in order to fill always the inside of the pipe system and the nozzle with liquid titanium tetrachloride. The maximum value of the inner diameter of the nozzle for filling always the inside of the pipe system and nozzle with titanium tetrachloride, which corresponds to the maximum supplying flow rate of titanium tetrachloride of 250 $kg/m^2 \cdot hr$ and the titanium tetrachloride-dropping backpressure condition in the conventional art, is about 12 mm based on experimental results, and this value is far smaller than the discharging pipe size employed in the conventional art. Moreover, the experimental results show that a smaller inner diameter of the nozzle at the same flow rate, i.e., a narrower flow results in a more stable flow and hence the flow is hardly changed into the two-phase flow. Since increase of the nozzle backpressure induces increase of nozzle flow rate, it is necessary to adopt a nozzle having an inner diameter of 12 mm or less in order to increase the nozzle backpressure in the case of operation at a flow rate similar to the maximum flow rate in the conventional art. The flow once changed into the two-phase flow in the pipe tends to consume momentum through resistance with surrounding gas and collision with the supply pipe wall and other liquid drops as compared with the single-phase flow, and thus most of the momentum originally possessed is lost within 2 m after the flow is changed into the two-phase flow. Even in the conventional art, an original pressure of the titanium tetrachloride-supply pipe of hundreds of thousands Pa is sometimes applied by a pump, a normal pressure low-speed flow results in at the outlet of the supply pipe in every case owing to the loss of momentum by the change into the two-phase flow in the pipe in the middle of the supply. Moreover, further increase of the original pressure of the titanium tetrachloride-supply pipe vainly results in only increase of pressure loss on the way of piping and makes only a little influence on final discharging flow rate, so that an extreme high pressurization of the original pressure has not been attempted. On the other hand, in the invention, the flow in the pipe is maintained in a single-flow state, wherein the pipe is always filled with titanium tetrachloride, until just before the discharge of titanium tetrachloride and the pressure loss on the way of piping is very low as compared with the case in the conventional art. Therefore, since the final discharging rate can be increased by increasing the original pressure at the titanium tetrachloride supply, a high-speed injection of liquid titanium tetrachloride is enabled under a nozzle high backpressure condition.

In addition, the difference in the flow state at the discharge of titanium tetrachloride into the reaction vessel between the conventional art and the invention also causes a difference in the vapor film shape formed on the bath surface between them. In the conventional art, titanium tetrachloride is dropped as unstable two-phase flow liquid drops, the liquid drops further disperses during their falling and falls in a wide range of the bath surface. As a result, the vapor film shape formed on the bath surface in the conventional art becomes a shallow and wide pan-bottom shape, which is disadvantageous for securing the penetration depth 32 from the bath surface. On the other hand, in the invention, since titanium tetrachloride discharged from the nozzle is rectified as a single-phase flow before the discharge and has a little turbulence and a high rectilinearity, the jet flow converges on a narrow range of the bath surface and collides therewith. As a result, the vapor film shape formed on the bath surface in the invention becomes a deep and narrow cave shape, which is advantageous for securing the penetration depth 32 from the bath surface.

Figure 14:
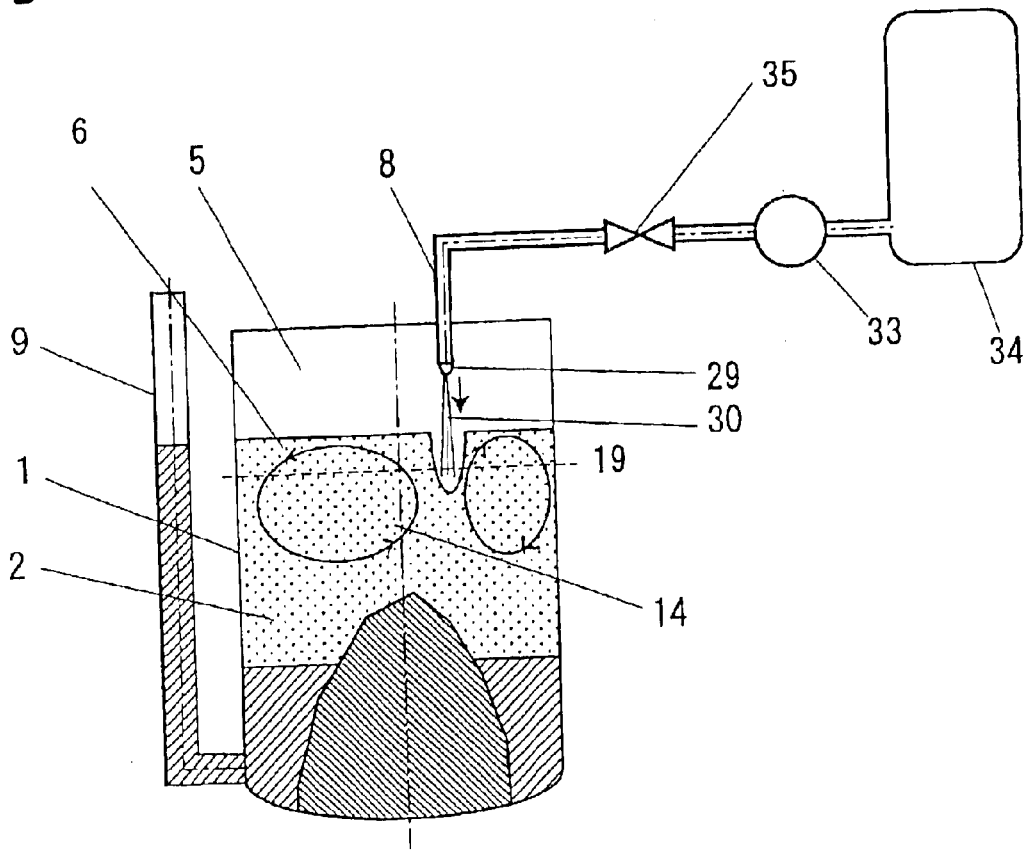
FIG. 14 is the conceptual illustration of the sixth invention.

The difference of the sixth invention from the other methods for imparting a stirring force to the bath liquid is that the bath liquid is stirred by the liquid titanium tetrachloride jet flow and hence titanium tetrachloride as the raw material is supplied together with imparting the stirring force. The role of supplying titanium tetrachloride in the sixth invention can be realized at various levels. Firstly, FIG. 12 is constituted by a titanium tetrachloride-supply pipe 8 in the conventional art and a liquid titanium tetrachloride-injecting nozzle 29 provided in a separate line as a stirring force-imparting apparatus, wherein main supply of titanium tetrachloride, i.e., main supply is carried out from the titanium tetrachloride-supply pipe 8 in the conventional art. In this constitution of equipment, individual conditions for main supply of titanium tetrachloride and supply of titanium tetrachloride for stirring the bath can be optimally set independently, and thus the operating conditions can be set with a high freedom. On the other hand, in the constitution of equipment shown in FIG. 14, the equipment is simplified by carrying out the main supply of titanium tetrachloride and the bath stirring with the same titanium tetrachloride-injecting nozzle. This is achieved by strictly setting optimal operating conditions to permit both of the main supply of titanium tetrachloride and supply of titanium tetrachloride for stirring. Moreover, in the constitution of equipment shown in FIG. 14, since whole supply of titanium tetrachloride can be applied to the bath stirring, a larger stirring effect can be easily obtained as compared with the constitution wherein only a part of supplied titanium tetrachloride is used for the stirring. Either of the constitutions may be selected based on the judgment from an engineering point of view, a required stirring effect, easiness of operation, cost of equipment, and the like being totally taken into consideration.

In carrying out the sixth invention, the penetration depth from the bath surface can be determined by inserting two electrodes into the reaction bath and measuring spatial distribution of current change between the electrodes. This is a method of detecting vapor utilizing the fact that electric resistance between electrodes remarkably increases when vapor generated with the penetration of titanium tetrachloride into the bath is present between the electrodes.

The following will describe the action of the seventh invention. The seventh invention defines specific operating conditions in the sixth invention. The principle of the sixth invention is that the collision of liquid titanium tetrachloride with the bath surface at a large collision pressure results in the formation of a vapor film at a position of deeper than 100 mm from the bath surface in the bath, which is accompanied by the increase of thickness of the circulating flow just under the bath surface. The principle itself is always correct. However, simple use of high-pressure, large size, and close-coming nozzle may invite generation of a large amount of droplets on the bath surface and the instruments and structures above the bath surface are contaminated with the droplets. Such contaminants on the surface of the instruments and structures contain a large amount of impurities such as iron eluted from the surface of the instruments and structures. The contaminants frequently fall on the bath surface during the operation of titanium tetrachloride reduction and are incorporated into product titanium, so that the generation of such bath liquid droplets should be avoided as far as possible at the production of high quality titanium metal wherein purity of product titanium is an important matter. Based on the precise investigations on conditions for applying the sixth invention to actual operation, in the seventh invention, the inventors have found individual operating conditions of inner diameter of nozzle, backpressure of nozzle, distance between nozzle and bath surface and nozzle shape, which minimize the generation of droplets from the bath surface and satisfy the penetration depth into the bath necessary for bath stirring. The following will specifically describe each operating condition. In this regard, within the range of these four operating conditions, an effect of extending the thickness of the circulating flow just under the bath surface is obtained in any combination of individual operating conditions but the degree of the effect of extending the thickness of the circulating flow, of course, varies depending on the combination of the conditions. That is, the effect of extending the thickness of the circulating flow is enhanced by setting the operating conditions as follows: a larger inner diameter of nozzle, a higher backpressure of nozzle, a shorter distance between nozzle and bath surface, and a longer straight pipe part in the vicinity of the nozzle outlet.

Figure 16:
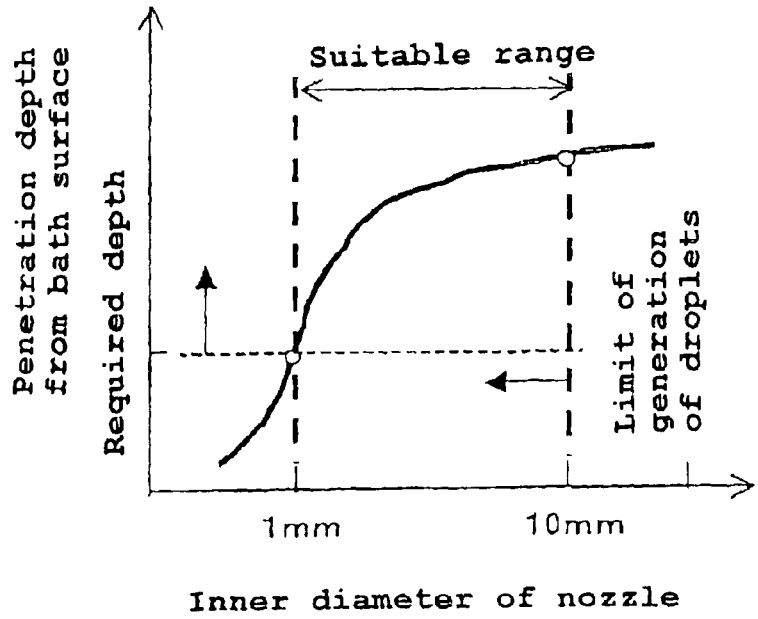
FIG. 16 is a conceptual illustration of the influence of an inner diameter of nozzle in the seventh invention.

Firstly, the influence of the inner diameter of the nozzle will be described with reference to FIG. 16. When the inner diameter of the nozzle is less than 1 mm, the jet flow is too fine to maintain a stable jet flow in the cave-like vapor film in the bath, and hence the required penetration depth of 100 mm under the bath surface cannot be satisfied. On the other hand, as the inner diameter of the nozzle increases, the cross-sectional area of the titanium tetrachloride jet flow colliding with the bath surface increases, so that the amount of bath liquid to be excluded from the bath surface and inside of the bath by the penetration of the jet flow into the bath also increases to result in a rapid increase of generation of droplets of the bath liquid, size of the droplets, and scattering range of the droplets. When the inner diameter of the nozzle exceeds 10 mm, the generation of the droplets is particularly remarkable and large droplets having a diameter of 10 mm or more are directly scattered and attached to the wall of the vessel, and hence a general allowable quality range of high-grade titanium metal cannot be maintained owing to the contamination of product titanium caused by elution of vessel components. Since the generation of the droplets in the case of the inner diameter of the nozzle exceeding 10 mm cannot be suppressed within an allowable range even when each of the other three operating conditions are set any value within the defined range of the conditions, it is impossible to apply such a condition of the inner diameter of the nozzle. Accordingly, a suitable range for the inner diameter of the nozzle is from 1 mm to 10 mm.

Figure 17:
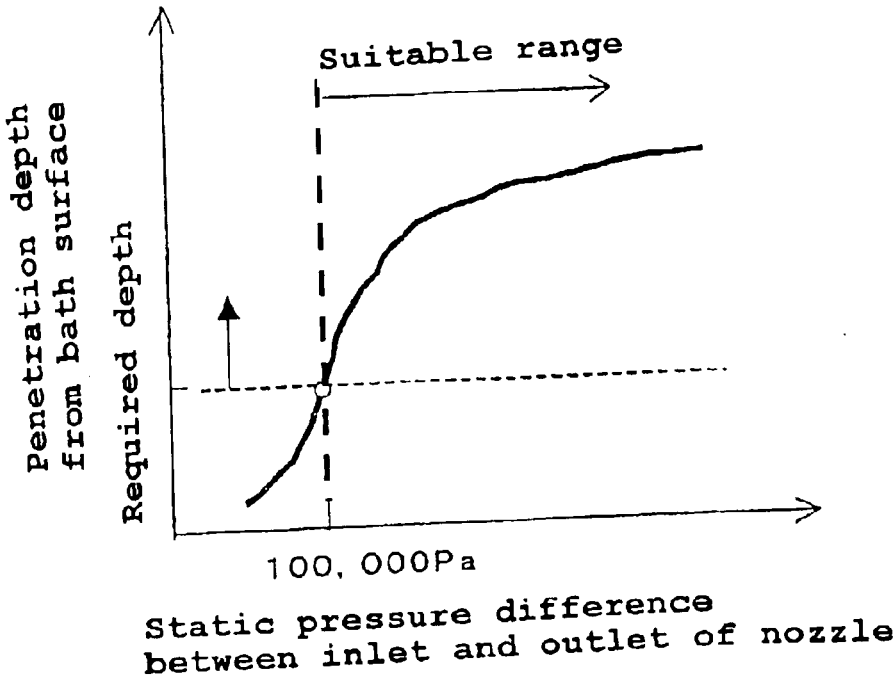
FIG. 17 is a conceptual illustration of the influence of a nozzle inlet-outlet static pressure difference in the seventh invention.

Secondly, the influence of the nozzle backpressure will be described with reference to FIG. 17. Since the over-bath gas in the reaction vessel to which the jet flow is discharged has a slightly positive pressure of about tens of thousands Pa, the static pressure difference between the nozzle pressure and the nozzle outlet pressure is used as a definition of the operating condition. In the case that the distance between the nozzle and the bath surface is about 1000 mm or less, the nozzle backpressure almost uniquely determines a maximum collision force at the time when the liquid titanium tetrachloride jet flow 30 collides with the bath surface. Moreover, with regard to the penetration depth 32 into the bath, it is not probable that the liquid titanium tetrachloride jet flow penetrates into a depth in the bath at which a collision pressure of the liquid titanium tetrachloride jet flow 30 largely exceeds a static pressure which the cave-like titanium chloride vapor film receives from the surrounding bath liquid, the collision pressure being defined by [collision force]/[collision cross-sectional area]. That is, a physical lower limit of the nozzle backpressure exists for a certain required penetration depth into the bath. The condition for satisfying the penetration depth required for exhibiting the effect of extending the thickness of the circulating flow just under the bath surface is a pressure difference between inlet and outlet of the nozzle of 100,000 Pa or more. When the pressure difference between inlet and outlet of the nozzle exceeds 5,000,000 Pa, the operation becomes impossible owing to the generation of the droplets on the bath surface. Therefore, with regard to the pressure difference between inlet and outlet of the nozzle, a suitable operating condition is from 100,000 to 5,000,000 Pa.

Figure 18:
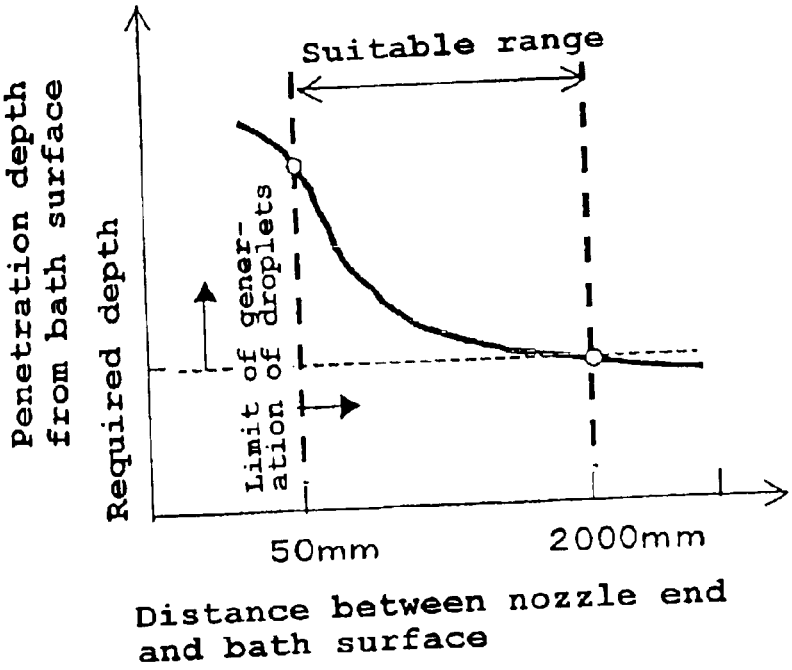
FIG. 18 is a conceptual illustration of the influence of the distance between nozzle end-bath surface in the seventh invention.

Thirdly, the influence of the distance between the nozzle and the bath surface will be described with reference to FIG. 18. As the discharged jet flow flies, the collision cross-sectional area becomes large and hence the collision pressure decreases. From the above-described relationship between the nozzle collision pressure and the penetration depth into the bath, the inventors have found that the condition for satisfying the penetration depth required for exhibiting the effect of extending the thickness of the circulating flow just under the bath surface in the invention is a distance between the nozzle end and the bath surface of 2000 mm or less. On the other hand, when the distance between the nozzle end and the bath surface is less than 50 mm, the droplets are remarkably generated and a large amount of the droplets attach to the nozzle or nozzle cover, so that the operation cannot be continued. Accordingly, a suitable operating condition range for the distance between the nozzle end and the bath surface is from 50 mm to 2000 mm.

Figure 19:
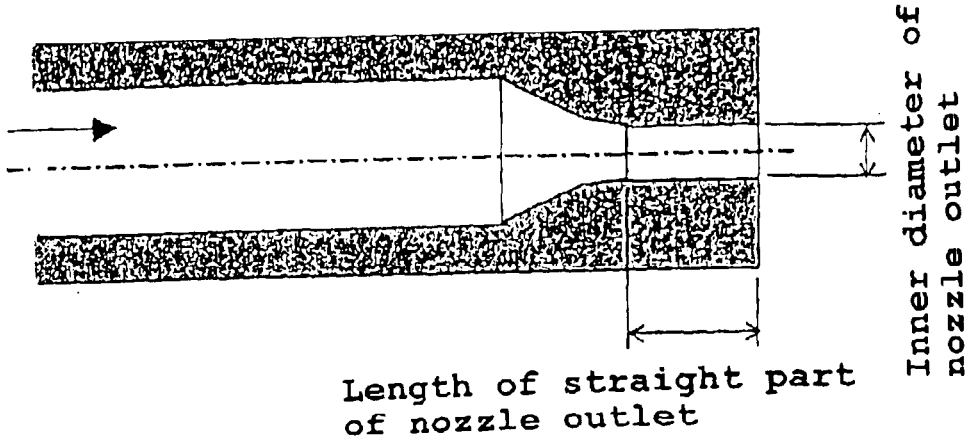
FIG. 19 is a conceptual illustration of the cross-sectional shape in a nozzle in the seventh invention.
Figure 20:
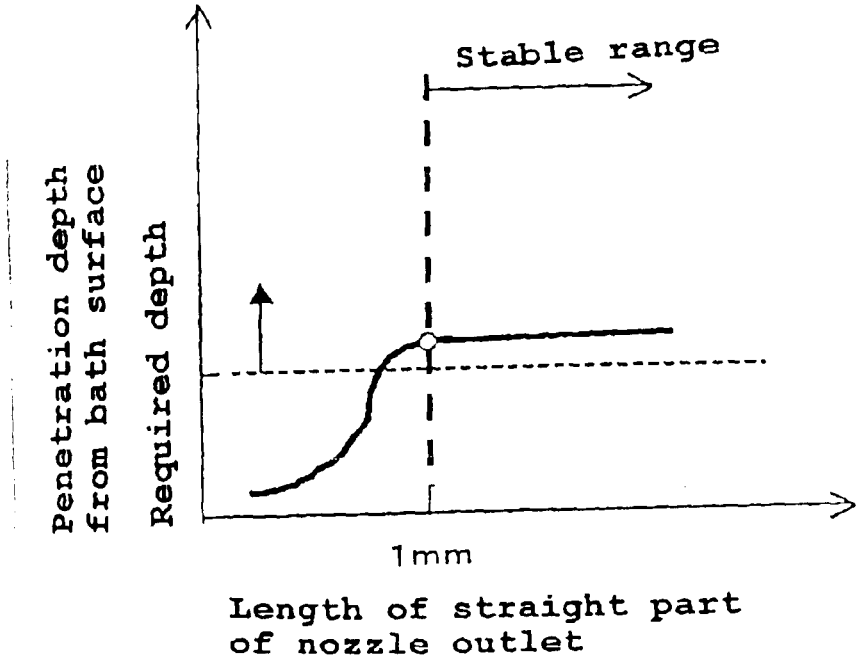
FIG. 20 is a conceptual illustration of the influence of length of the straight part of the inlet in a nozzle in the seventh invention.

Fourthly, the influence of the nozzle shape will be described with reference to FIG. 20. The representative examples as a single-phase liquid injection nozzle include a nozzle having a shape wherein the cross-sectional area in the vicinity of the nozzle outlet is gradually extended toward the outlet and having a purpose of converting the injecting liquid into droplets or dispersing the liquid, i.e., a spray nozzle, and a straightly injecting nozzle wherein the cross-sectional area in the vicinity of the outlet is almost constant toward the outlet. Based on the findings obtained by the inventors, when a common spray nozzle having a nozzle taper angle of more than 10° is applied to the sixth invention, because of the increased collision cross-sectional area on the bath surface, a relatively large nozzle backpressure and supplying liquid flow rate are required as compared with a straightly injecting nozzle for satisfying required penetration depth into the bath, and hence the nozzle is disadvantageous in view of the generation of droplets from the bath surface. Therefore, the application of a straightly injecting nozzle as a nozzle shape is a suitable operating condition. The cross-sectional shape of the straightly injecting nozzle will be described with reference to FIG. 19. Liquid titanium tetrachloride supplied from upstream is narrowed in the straightly injecting nozzle as the flow passes and is speeded up. At that time, the nozzle backpressure is converted into momentum of the liquid flow. The liquid flow after narrowed is rectified in the nozzle outlet straight part provided just before the nozzle outlet and the static pressure of the flow in the nozzle is reduced to the direction which harmonizes with the pressure of the gas outside the nozzle. The specific effects of the nozzle outlet straight part are, firstly, to reduce the intensity of turbulence of the discharged jet flow to prevent scattering of the jet flow after its discharge and, secondly, to function as a field of converting the static pressure into momentum, thereby the static pressure of the jet flow at the discharge being harmonized with the gas pressure of the destination to prevent explosive scattering of the jet flow based on the static pressure difference between the jet flow and the gas at the discharge. In this regard, the cross-sectional shape of the straightly injecting nozzle is not necessarily a circular shape and may be, for example, an elliptical shape or a rectangular shape. Moreover, the outlet of the straightly injecting nozzle may sometimes be subjected to a chamfer processing for preventing uneven discharge of the jet flow caused by a nozzle outlet loss, but when the chamfer is so little as, for example, 1 mm or less, the nozzle also inhibits substantially the same jet flow characteristics as those of the straightly injecting nozzle and hence can be regarded as one type of the straightly injecting nozzle. Moreover, it may be probable that a gimlet-bored hole is simply provided for the wall of the titanium tetrachloride-supply pipe and the liquid is injected from the hole. When the depth of the gimlet-bored hole is about 1 mm or more, rectification of the jet flow can be expected during its passage through the hole and hence this bored pipe is also regarded as one type of the straightly injecting nozzle. That is, for achieving rectilinearity, it is advantageous to have a straight part in the vicinity of the nozzle outlet because of a little spread of the liquid jet flow in the radial direction of the jet flow. As a result of the investigation on the relationship between the length of the straight part in the vicinity of the nozzle outlet and the penetration depth into the bath liquid shown in FIG. 20, when the length of the straight part in the vicinity of the nozzle outlet is less than 1 mm, it has been found that the linearity of the liquid titanium tetrachloride jet flow rapidly deteriorates and the penetration depth into the bath is decreased. The inventors have found that the value of 1 mm is a universal limit for the straightly injecting nozzle having a nozzle inner diameter of 1 to 10 mm that is within the range of the operation condition. The longer the length of the straight part in the vicinity of the nozzle outlet is, the more the rectifying effect increases. However, when the length of the straight part in the vicinity of the nozzle outlet is extremely long, the operating cost increases owing to pressure loss. Thus, it is concluded that a suitable operating condition range is to set the length of the straight part in the vicinity of the nozzle outlet to 1 mm or more. In this regard, an optimal operating condition is described for the straightly injecting nozzle having a straight part in the vicinity of the nozzle outlet, but a tapered nozzle wherein the cross-sectional area is gradually narrowed toward the nozzle outlet side or a divergent nozzle wherein the area gradually diverges toward the nozzle outlet side shows a similar performance to that of the straightly injecting nozzle when the taper angle is so small as 30° C. or less in the case of the tapered nozzle or 10° C. or less in the case of the divergent nozzle. In these cases, the nozzle shape such as the tapered nozzle or the divergent nozzle does not contributes such a high performance but the performance is simply due to a little influence of the tapered structure thanks to a small taper angle, i.e., due to the similarity in shape to the straightly injecting nozzle. Therefore, the working principle and the effects thereof are totally not different from those described with regard to the straightly injecting nozzle. Accordingly, the invention includes these tapered nozzle and divergent nozzle having a small taper angle.

The term "taper angle" herein means an angle at which a hypothetical plane extended along the incline of the nozzle inner wall in the axial direction of the nozzle may cross the nozzle axis. All the angles of the tapered nozzle, divergent nozzle, and spray nozzle are shown by acute angles. Namely, for the tapered nozzle, it is an angle at which the nozzle inner wall extended forward may cross the nozzle central axis. For the divergent nozzle, it is an angle at which the nozzle inner wall extended backward may cross the nozzle central axis. In the tapered nozzle and divergent nozzle, the portion continuously having a small taper angle within the range described above is regarded as the part corresponding to the straight part.

Moreover, the "vicinity" of "in the vicinity of the nozzle outlet" in claim 7 means the region within about 10 mm from the nozzle end at the outlet side. However, in the case that the cross-sectional area in the axial direction changes rapidly at the nozzle end at the outlet side, for example, a chamfer having an angle of 45° is provided for the nozzle end, when the length of the chamfer part largely exceeds 1 mm from the nozzle end, the jet flow is widely scattered and the linearity of the jet flow remarkably deteriorates. Therefore, in this case, the "vicinity" means within 1 mm from the nozzle end. Thus, the "vicinity" is suitably set in each nozzle condition as a region wherein the linearity is maintained.

Figure 21:
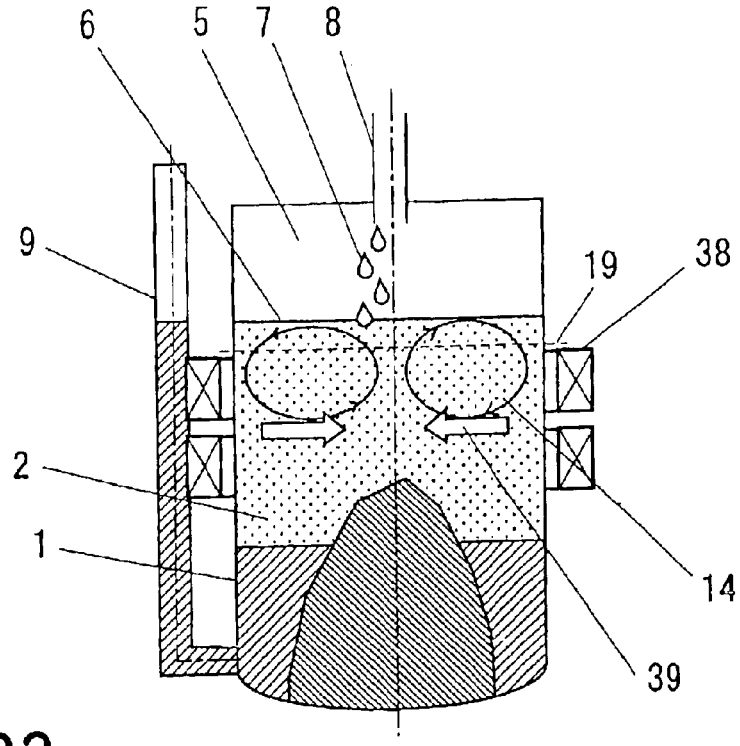
FIG. 21 is a conceptual illustration of the eighth invention.
Figure 22:
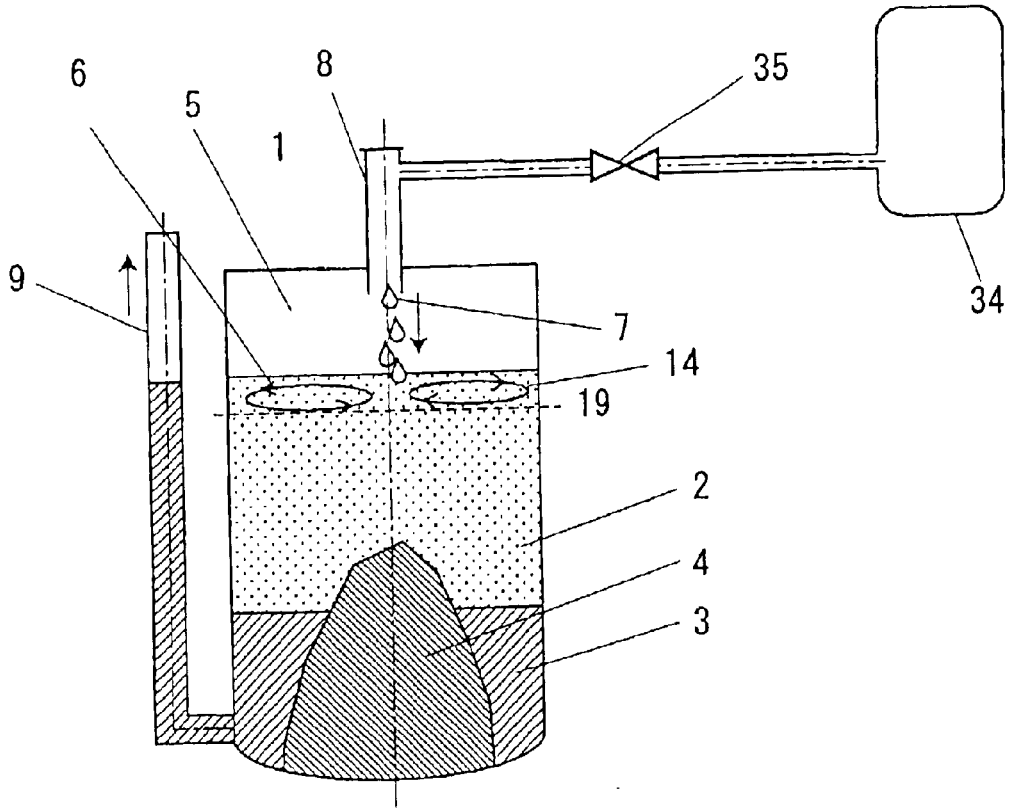
FIG. 22 is a conceptual illustration of a titanium reduction apparatus in the conventional art.
Figure 23:
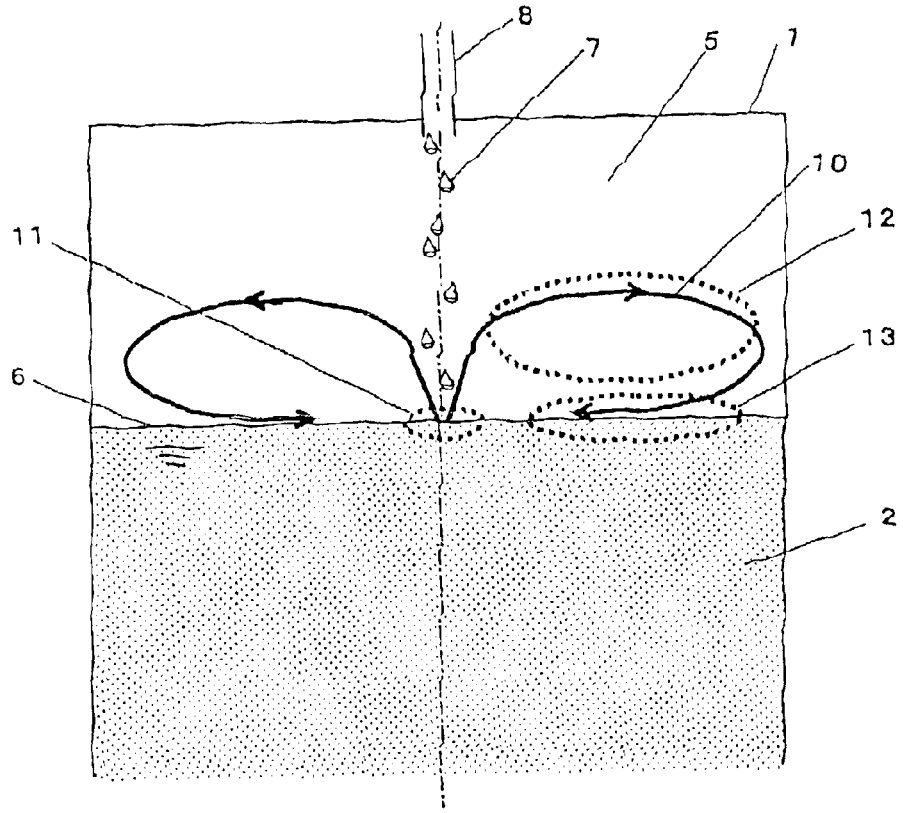
FIG. 23 is a conceptual illustration of a reaction site in a conventional apparatus.
Figure 24:
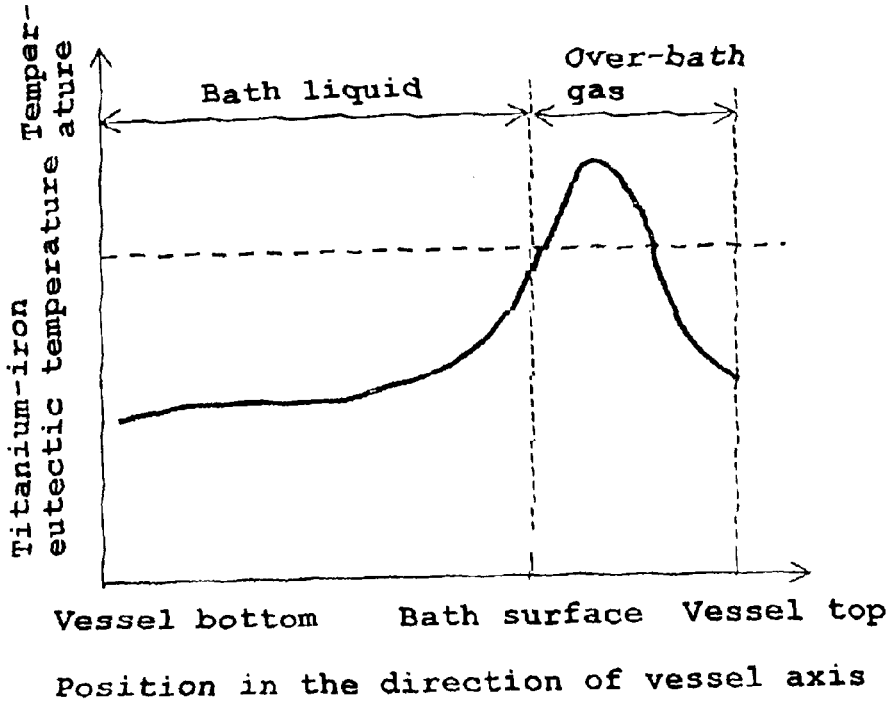
FIG. 24 is a conceptual illustration of a bath liquid temperature distribution in the axial direction of a vessel in a conventional apparatus.
Figure 25:
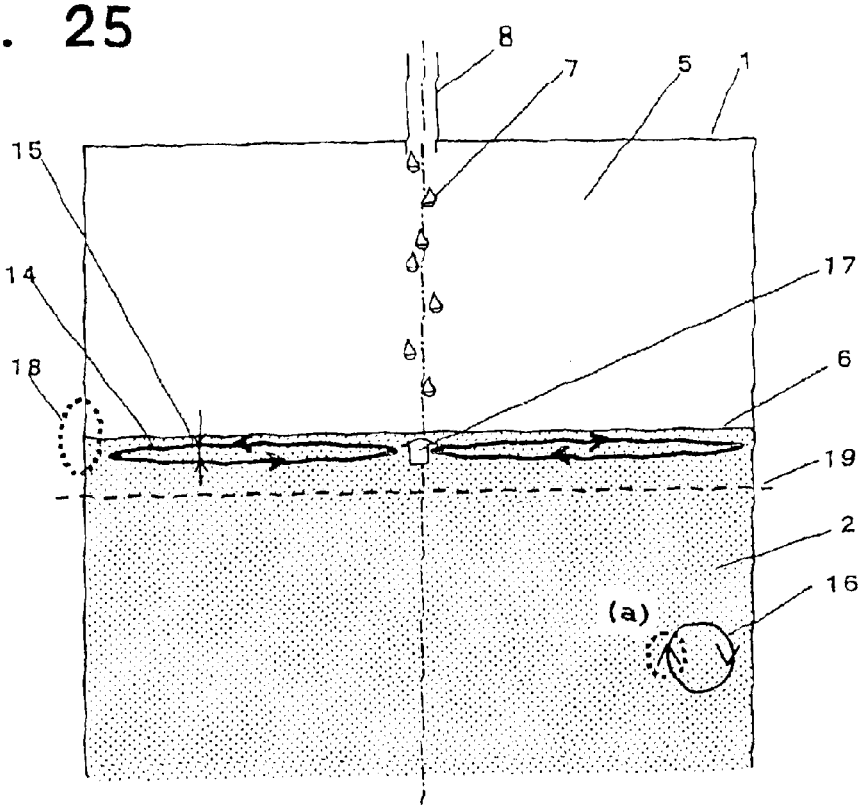
FIG. 25 is a conceptual illustration of a bath liquid flow field in a conventional apparatus.
Figure 26:
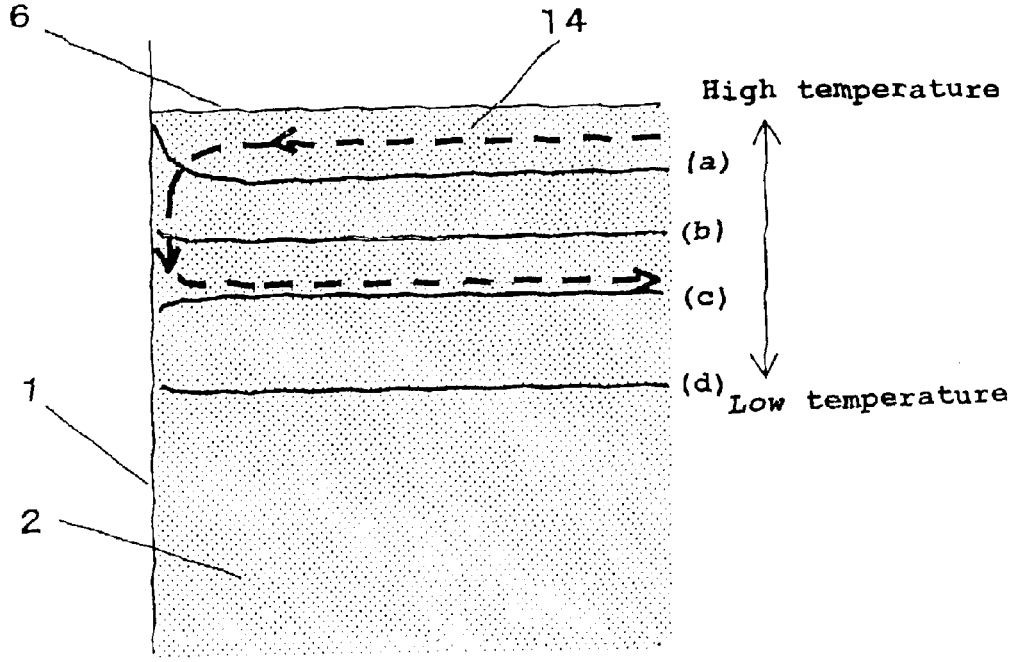
FIG. 26 is a conceptual illustration of a bath liquid temperature distribution in a conventional apparatus.
Figure 27:
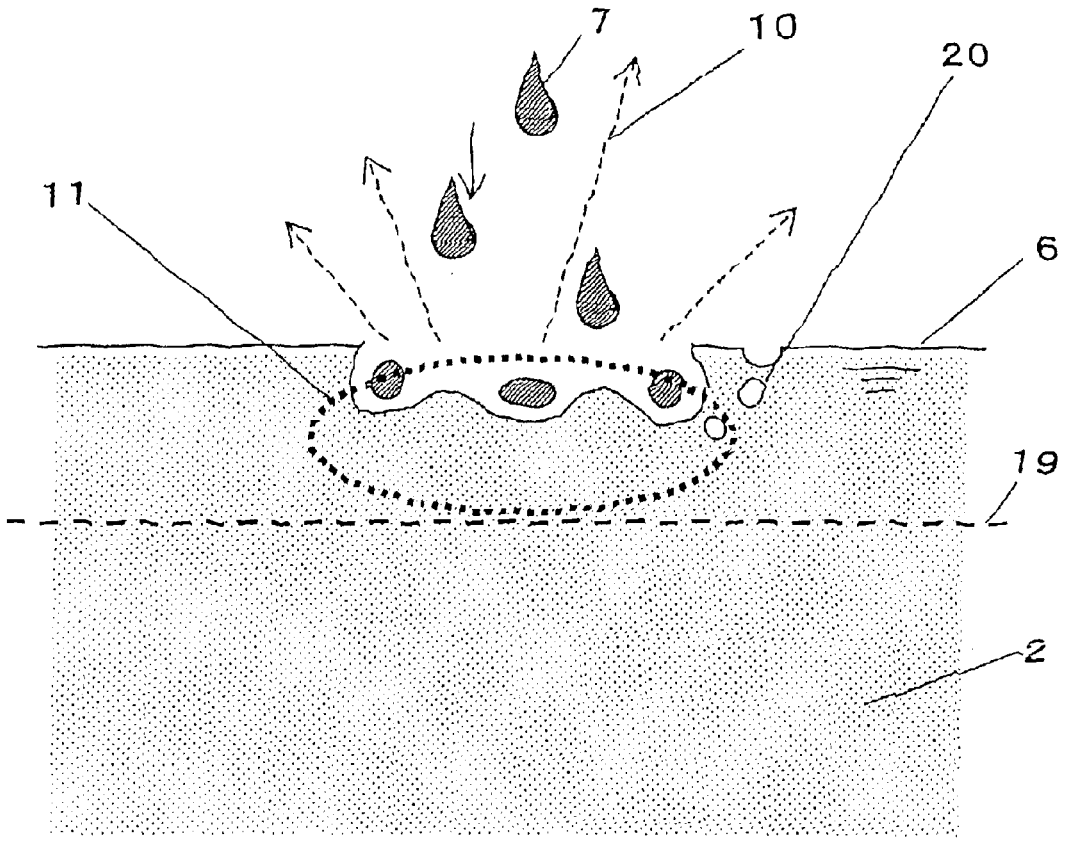
FIG. 27 is a conceptual illustration of a phenomenon at a titanium tetrachloride drop-falling part in a conventional apparatus.

The following will describe the action of the eighth invention with reference to FIG. 21. In any of the first invention to the seventh invention, the reaction vessel 1 is surrounded by a coil 38 where electric wire is wound on an iron core. When alternative current is sent to the coil, a periodically varying electromagnetic wave is generated around the coil. The periodically varying electromagnetic wave acts on the magnesium bath liquid which is an electric conductor in the reaction vessel, as an electromagnetic inductive force, i.e., a pinch force 39 so-called by those skilled in the art to move magnesium bath liquid at the position corresponding to the horizontal cross-section of the coil to the inside in the radial direction. The flows of the magnesium liquid driven by the pinch force in the radial direction are combined at the central axis part of the reaction vessel and turn to upward and downward to form upper and lower circulating flows in the reaction vessel. As a result of investigations, the inventors have found that the upper circulating flow generated by the pinch force incorporates with the circulating flow just under the bath surface existing in the conventional operation to extend the thickness of the circulating flow just under the bath surface and thereby brings effects of homogenizing the bath temperature and also lowering the surface temperature of the bath liquid, when the height to which the coil is placed is in the range of 100 mm to 2000 mm below the bath surface in the direction of the bath depth. Moreover, since the level of the bath surface varies during the operation, a stable stirring effect can be attained by moving the pinch force-imparting coil 38 in the direction of the bath height corresponding to the shift of the bath surface or by providing a number of coils in the height direction and selecting and employing the coil present at the most suitable position on all such occasions.

The present invention will be illustrated in greater detail with reference to the following Examples, but the invention should not be construed as being limited thereto.

This chapter shows Examples operated at 250 $kg/m^2 \cdot hr$ which is a condition corresponding to a maximum flow rate of titanium tetrachloride in the conventional art.

EXAMPLE 1

First, Examples of the first to third inventions are described. In a titanium reduction reaction apparatus having a vessel diameter of 2 m and a height of 5 m, a stainless steel screw 22 corresponding to a maximum thrust of 100 N was provided at a fixed position in the range of 50 to 500 mm below the bath surface in the reaction bath liquid and at a position 400 mm apart from the central axis of the vessel in the radial direction of the vessel so that the screw rotation axis is parallel to the vessel axis, and the screw 22 was rotated through a stainless steel shaft 23 by an electric motor 25 placed outside the reaction vessel to generate an upward bath liquid flow before and after the screw 22. When the screw-provided position in the axial direction of the vessel is 50 mm below the bath surface, a screw thrust of 100 N was imparted. As a result, it was confirmed by measuring a bath flow rate distribution that the thickness 15 of the circulating flow just under the bath surface became 1 m or more. In addition, it was also confirmed from the results of the measurement of a bath flow rate distribution that the temperature difference in the bath liquid decreased from 200° C. to 30° C., which showed temperature homogenization of the bath, and also the maximum temperature on the bath surface dropped from 1050° C. to 940° C. When the screw was provided at a position of 500 mm below the bath surface, a similar effect was obtained by imparting a screw thrust of 1 N. Moreover, influx of outside air was prevented by providing a labyrinth seal as a seal mechanism 24 for the shaft 23 and controlling the inner pressure of the vessel so as to be a slightly positive pressure.

EXAMPLE 2

Example of the fourth invention is described. In a titanium reduction reaction apparatus having a vessel diameter of 2 m and a height of 5 m, a stirring bar 26 was provided at a position 400 mm apart from the central axis of the vessel in the radial direction of the vessel below the bath surface in the reaction bath liquid so that the central axis of the bar is parallel to the vessel axis. Then, so as to reciprocate the end of the stirring bar 26 in the range of a fixed length stroke of 50 to 500 mm which was centered at a fixed position in the range of 100 to 500 mm below the bath surface, the moving position and reciprocating cycle of an air cylinder 25 placed outside the reaction vessel and directly connected with the stirring bar were controlled. The stirring bar was made of stainless steel and, for enhancing a stirring effect, a stainless steel disk having a diameter of 200 mm and a thickness of 25 mm was welded to the end of the stirring bar so as to be perpendicular to the vessel axis. In the range of the reciprocating cycle of the stirring bar of 1 to 60 seconds and the range of the stirring bar-reciprocating stroke of 100 to 500 mm, the thickness 15 of the circulating flow just under the bath surface became about twice the distance from the bath surface to the deepest depth to which the stirring bar reached, and the temperature of the bath was homogenized. When the stirring bar stroke is less than 100 mm, the thickness of the circulating flow just under the bath surface rapidly decreased as the stirring bar stroke shortened. The constitution of the seal mechanism 24 is the same as in the second invention.

EXAMPLE 3

Example of the fifth invention is described. In a titanium reduction reaction apparatus having a vessel diameter of 2 m and a height of 5 m, a stainless steel pipe having an inner diameter of 10 mm and a length of 3 m, the outer wall surface of which was thermally sprayed with alumina, was used as a stirring gas-supply pipe 27 and one end thereof was immersed into the bath liquid and another end was drawn out of the vessel and connected with a rubber tube for supplying stirring gas. The thermal spray with alumina was conducted for the purpose of reducing the elution of the pipe surface and reducing the precipitates in the bath. In the case that the metal pipe surface came directly into contact with the reaction bath liquid, the effect of reducing the precipitation on the pipe surface is based on the fact that the pipe surface functions as a catalyst for titanium reduction reaction to accelerate the reaction on the pipe surface and the precipitation of titanium since it is easy to move electron charge in the metal. The immersed depth of the stirring gas-supply pipe 27 in the bath liquid can be changed by sliding an opening of the top of the reaction vessel upward or downward. The gap between the opening of the top of the reaction vessel and the outer wall of the stirring gas-supply pipe 27 was sealed by brazing. Argon gas non-reactive with titanium and magnesium was used as the stirring gas and was released from an argon gas bomb into the bath liquid through the stirring gas-supply pipe 27 after pressurized to a predetermined pressure by a compressor. When argon gas was supplied at about 0.1 kg/second or less, argon mainly formed bubbles 28 and ascended in the bath liquid. When the supply exceeded the value, argon gas in the bath formed a single-phase gas film having a shape directly connecting the outlet of the stirring gas-supply pipe 27 with the bath surface, and a stirring force in the bath was mainly imparted by the gas which could not incorporated with the single-phase gas film and formed isolated bubbles around the gas film. In the case that the immersed depth of the stirring gas-supply pipe 27 in the bath liquid was 500 mm, as a result of the supply of argon gas at 0.01 kg/second or more, it was confirmed by measuring the bath flow that the thickness 15 of the circulating flow just under the bath surface became 1 m or more and it was also confirmed from the results of measuring bath temperature that the maximum temperature of the bath surface dropped and the temperature in the bath was homogenized. In the case that the immersed depth in the bath liquid was 50 mm or less, discharged argon gas was easily connected with the bath surface and isolated bubbles were difficult to form in the bath liquid, so that a bath stirring-enhancing effect was hardly attained. Moreover, since argon gas released into the bath was accumulated in the vessel as over-bath gas, the over-bath gas was suitably discharged into the air after subjected to a waste gas treatment by washing with water, in the case that the inner pressure of the vessel exceeded a predetermined limit.

EXAMPLE 4

Examples of the sixth and seventh inventions are described. In a titanium reduction reaction apparatus having a vessel diameter of 2 m and a height of 5 m, a titanium tetrachloride-supply nozzle 29 was provided at a fixed position in the range of 50 to 2000 mm from the bath surface above the bath surface and at a position 200 mm apart from the central axis of the vessel in the radial direction of the vessel in a perpendicular and opposed manner to the bath surface. After supplied from a supply tank and pressurized to a predetermined pressure by a pump, liquid titanium tetrachloride was discharged toward the bath surface as a liquid titanium tetrachloride jet flow 30 through a titanium tetrachloride-supply pipe 8 and the nozzle 29. The nozzle was made of stainless steel which is inexpensive and has a high toughness or sintered alumina which has high thermal resistance and adhesion-resistance, and a cylindrical cross-section nozzle (straightly injecting nozzle) having an inner diameter ranging 1 to 10 mm was used and the length of straight part of the nozzle outlet was from 1 to 10 mm. Furthermore, a nozzle backpressure was set at a value ranging from 100,000 to 5,000,000 Pa. As a result, the thickness 15 of the circulating flow just under the bath surface was found to be 500 mm or more in every condition and the temperature in the bath was homogenized.

EXAMPLE 5

Figure 15:
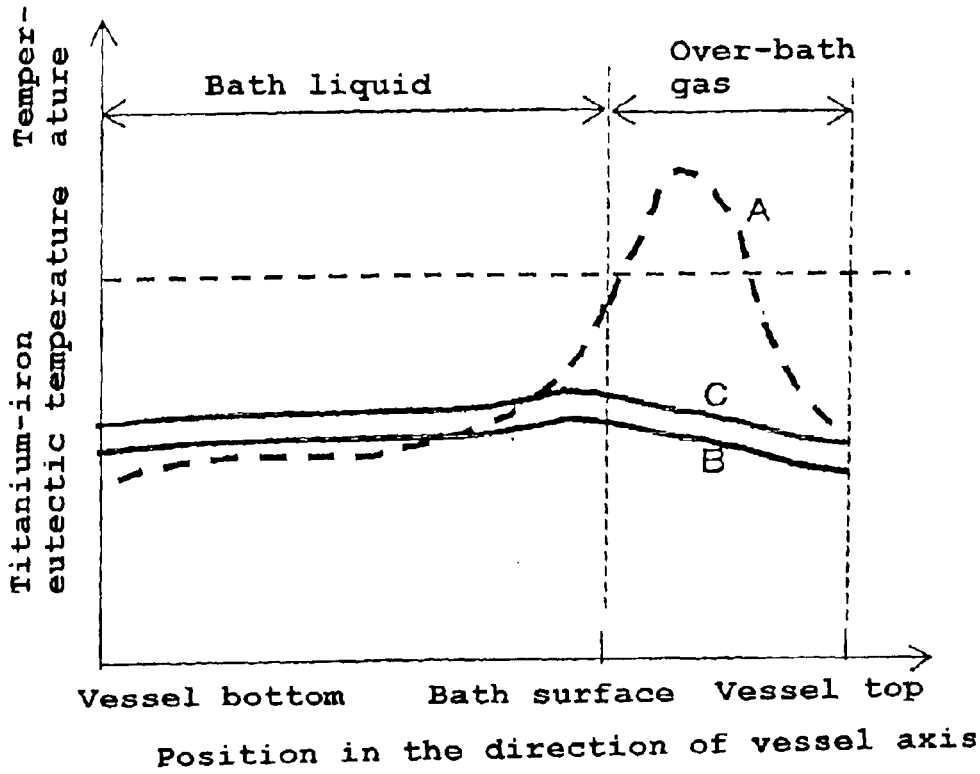
FIG. 15 is a conceptual illustration of the effect of the invention.

In Example 1, an experiment was carried out while the titanium tetrachloride supply was set at 500 kg/m 2·hr that is twice the maximum flow rate in the conventional art. FIG. 15, Line C shows the temperature distribution in the reaction vessel at that time.

EXAMPLE 6

FIG. 15, Line C shows an example of the temperature distribution in the reaction vessel in the case that the titanium tetrachloride supply was set at the flow rate that is twice the maximum flow rate, i.e., 250 $kg/m^2 \cdot hr$ in the conventional art. As compared with FIG. 15, Line B that is an example of the temperature distribution in the reaction vessel at the maximum flow rate in the conventional art using the apparatus of the invention, Line C shows a higher temperature all over the range owing to increased generation of heat in the vessel. However, in comparison with FIG. 15, Line A that is an example of the temperature distribution in the reaction vessel at the maximum flow rate in the conventional art using a conventional apparatus, the maximum temperature in Line C is far lower than the maximum temperature in Line A, so that a continuous operation is possible.

COMPARATIVE EXAMPLE

FIG. 15, Line A shows the temperature distribution in the reaction vessel at 250 $kg/m^2 \cdot hr$ that is the maximum flow rate in the conventional art using a conventional apparatus. In comparison with Lines B and C in the invention, there exists a high temperature region near the bath surface and hence the conventional art is disadvantageous in view of critical productivity.

While the invention has been described in detail and with reference to specific embodiments thereof, it will be apparent to one skilled in the art that various changes and modifications can be made therein without departing from the spirit and scope thereof.

What is claimed is:

1. A process for producing metallic titanium which comprises forming metallic titanium fine particles by supplying liquid or mist titanium tetrachloride from above the surface of a reaction bath liquid composed of fused magnesium and fused magnesium chloride in a reaction vessel to effect a reaction, wherein a circulating flow of the reaction bath liquid perpendicular to the bath surface is generated or extended just under the bath surface by imparting a stirring force to the reaction bath liquid so as to generate or increase an upward flow rate of the reaction bath liquid in at least part of the region at a depth of more than 100 mm below the bath surface of the reaction bath liquid.

2. The process for producing metallic titanium according to claim 1, wherein an average temperature of the reaction bath liquid is set at 770° C. or higher and a maximum temperature on the bath surface is set at 950° C. or lower.

3. The process for producing metallic titanium according to claim 1, wherein the stirring force is imparted to the reaction bath liquid by inserting a screw into the reaction bath liquid and rotating the screw.

4. The process for producing metallic titanium according to claim 1, wherein the stirring force is imparted to the reaction bath liquid by inserting a rod-like or spatular structure into the reaction bath liquid and rotating or oscillating the structure or moving it upward and downward.

5. The process for producing metallic titanium according to claim 1, wherein the stirring force is imparted to the reaction bath liquid by providing a gas outlet nozzle in the reaction bath liquid and discharging a gas non-reactive with the reaction bath liquid into the reaction bath from the outlet nozzle.

6. The process for producing metallic titanium according to claim 1, wherein titanium tetrachloride is supplied and also the stirring force is imparted to the reaction bath liquid by introducing back-pressured titanium tetrachloride into the reaction bath liquid through a nozzle placed above the bath surface of the reaction bath liquid toward the bath surface to allow titanium tetrachloride to reach a depth of more than 100 mm below the bath surface.

7. The process for producing metallic titanium according to claim 6, wherein the nozzle has a minimum inner diameter of 1 to 10 mm and a region at which the cross-sectional shape and cross-sectional area of the nozzle are maintained constant over a length of 1 mm or more in the direction of nozzle axis at the nozzle outlet or in the vicinity of the nozzle outlet, and a static pressure difference between inlet and outlet of the nozzle is kept in the range of 100,000 to 5,000,000 Pa and distance between the nozzle end and the bath surface is in the range of 50 to 2000 mm.

8. The process for producing metallic titanium according to claim 7, wherein the nozzle has an inner diameter of 1 to 10 mm.

9. The process for producing metallic titanium according to claim 1, wherein the stirring force is imparted to the reaction bath liquid by applying an electromagnetic stirring force to the reaction bath liquid from the outside of the reaction vessel.

* * * * *